US012571410B2

(12) United States Patent
Beristany et al.

(10) Patent No.: US 12,571,410 B2
(45) Date of Patent: Mar. 10, 2026

(54) BRACE FOR CEILING DROP

(71) Applicant: Hubbell Incorporated, Shelton, CT (US)

(72) Inventors: Victor Beristany, South Bend, IN (US); Krzysztof Korcz, Granger, IN (US); Krishna Patel, Granger, IN (US)

(73) Assignee: Hubbell Incorporated, Shelton, CT (US)

( * ) Notice: Subject to any disclaimer, the term of this patent is extended or adjusted under 35 U.S.C. 154(b) by 19 days.

(21) Appl. No.: 18/443,972

(22) Filed: Feb. 16, 2024

(65) Prior Publication Data

US 2024/0288006 A1 Aug. 29, 2024

Related U.S. Application Data

(60) Provisional application No. 63/603,334, filed on Nov. 28, 2023, provisional application No. 63/448,851, filed on Feb. 28, 2023.

(51) Int. Cl.
*F04D 29/62* (2006.01)
*F04D 25/08* (2006.01)

(52) U.S. Cl.
CPC ..... *F04D 29/626* (2013.01); *F04D 25/088* (2013.01)

(58) Field of Classification Search
CPC .... F04D 29/626; F04D 25/088; F04D 29/601; F04D 29/646; H02G 1/00; H02G 3/08; H02G 3/081; H02G 3/14
See application file for complete search history.

(56) References Cited

U.S. PATENT DOCUMENTS 4,880,128 A * 11/1989 Jorgensen ..... H02G 3/20 220/3.9
RE33,147 E * 1/1990 Reiker ..... F24F 13/32 248/200.1
4,892,211 A 1/1990 Jorgensen
5,263,676 A 11/1993 Medlin, Jr. et al.
5,407,088 A 4/1995 Jorgensen et al.
5,857,581 A 1/1999 Jorgensen
5,950,853 A 9/1999 Jorgensen
6,100,469 A 8/2000 Jorgensen et al.
(Continued)

OTHER PUBLICATIONS

International Search Report and Written Opinion issued Jul. 18, 2024, by the International Searching Authority in corresponding International Patent Application No. PCT/US2024/016174. (22 pages).

*Primary Examiner* — Aaron R Eastman
(74) *Attorney, Agent, or Firm* — Robinson + Cole LLP

(57) ABSTRACT

A ceiling fan mounting assembly that includes a ceiling fan box that is positioned at least partially through an opening in a ceiling. The ceiling fan box includes a riser portion that is positioned within the ceiling in use and includes a channel with a partially enclosed perimeter. The ceiling fan mounting assembly also includes a mounting bracket that has a base portion with an opening and a mounting finger that extends away from the base portion. The mounting bracket can connect to the ceiling fan box where the opening extends at least partially around the outer perimeter of the riser portion. The mounting finger is received within the channel and can translate within the channel as the mounting bracket moves relative to the ceiling fan box.

20 Claims, 36 Drawing Sheets

(56) References Cited

U.S. PATENT DOCUMENTS

| | | | | |
|---|---|---|---|---|
| 6,827,229 | B2 * | 12/2004 | Dinh | H02G 3/20 220/3.9 |
| 7,191,994 | B2 | 3/2007 | Johnson et al. | |
| 7,388,150 | B2 * | 6/2008 | Dinh | H02G 3/126 174/58 |
| 8,033,787 | B1 * | 10/2011 | Miller | F04D 25/088 416/246 |
| 9,822,926 | B2 * | 11/2017 | Nikayin | H02G 3/12 |
| 9,887,524 | B1 | 2/2018 | Gretz | |
| 11,536,029 | B2 | 12/2022 | Beristany et al. | |
| 11,581,718 | B2 * | 2/2023 | Korcz | H02G 3/123 |
| 2002/0179599 | A1 * | 12/2002 | Dinh | H02G 3/20 220/3.3 |
| 2006/0237601 | A1 * | 10/2006 | Rinderer | H02G 3/125 248/200.1 |
| 2007/0079981 | A1 * | 4/2007 | Dinh | H02G 3/126 174/58 |
| 2008/0230668 | A1 * | 9/2008 | Johnson | H02G 3/20 248/343 |
| 2014/0197165 | A1 * | 7/2014 | Korcz | H02G 3/10 220/3.9 |
| 2016/0273706 | A1 | 9/2016 | Lupsa et al. | |
| 2017/0204869 | A1 * | 7/2017 | Horng | F04D 29/601 |
| 2023/0057140 | A1 * | 2/2023 | Oh | H02G 3/08 |
| 2023/0113493 | A1 * | 4/2023 | Botkin | F04D 29/601 416/244 R |
| 2023/0318274 | A1 * | 10/2023 | Thomas | H02G 3/086 174/535 |
| 2023/0400148 | A1 * | 12/2023 | Wilson | H02G 3/125 |

* cited by examiner

BRACE FOR CEILING DROP

CROSS-REFERENCE TO RELATED APPLICATION

This application claims the benefit of U.S. Provisional Application No. 63/603,334, filed Nov. 28, 2023, and U.S. Provisional Application No. 63/448,851, filed Feb. 28, 2023, the entire contents of which are incorporated by reference herein in their entirety.

FIELD

The present disclosure relates to a mounting bracket. More particularly, the present disclosure relates to a ceiling mounting assembly that includes a mounting bracket that supports the weight of a ceiling fan.

BACKGROUND

Fans or other fixtures can be mounted in a ceiling above a room. A mounting assembly is used to support the weight of the fan. Many types of mounting assemblies use a brace that extends between ceiling joists. The brace may be inefficient at supporting heavy fans because the fan may be connected proximate to a center of the brace and thus distal to either joist. At this location, the weight of the ceiling fan may bend the brace and eventually cause the brace to fail. In other examples, a bracket may be connected proximate to a ceiling box. These brackets are generally connected to an upper portion of the box and require a long fastener (e.g., threaded screw) to connect to a joist. Although the distance between the box and the joist is decreased, the use of a long nail to span the distance between the box and the joist may still limit the total weight of the fan.

SUMMARY

Various examples of the present disclosure can overcome various of the aforementioned and other disadvantages associated with known mounting brackets and offer new advantages as well.

According to one aspect of various examples of the present disclosure there is provided a metallic mounting bracket for supporting the weight of a ceiling-mounted fan.

According to one aspect of various examples of the present disclosure there is provided a mounting bracket that can simultaneously connect to two perpendicular surfaces of a ceiling joist.

According to another aspect of various examples of the present disclosure, there is provided a mounting bracket that engages at least a portion of a perimeter of a ceiling fan box proximate to a lower end.

According to another aspect of various examples of the present disclosure, there is provided a mounting bracket for supporting a ceiling fan and ceiling fan box, the mounting bracket comprising a body having an opening that is configured to extend at least partially around the ceiling fan box.

According to another aspect of various examples of the present disclosure, there is provided a mounting bracket having a body and an opening partially contained within the body so that the opening has an incomplete perimeter. The opening configured to at least partially receive a ceiling fan box.

According to another aspect of various examples of the present disclosure, there is provided a mounting bracket having a body and an opening fully contained within the body so that the opening has a complete perimeter. The opening configured to receive a ceiling fan box.

According to another aspect of various examples of the present disclosure, there is provided a mounting bracket that includes an opening for at least partially receiving a perimeter of a ceiling fan box. Some examples of the opening may include a complete perimeter while other examples of the opening may include a partially enclosed perimeter.

According to another aspect of various examples of the present disclosure, there is provided a mounting bracket that includes a finger that can be received in and slid through a channel in a ceiling fan box.

According to another aspect of various examples of the present disclosure, there is provided a ceiling fan box having a channel and a mounting bracket having a finger. The finger is slidable through the channel as the ceiling fan box translates relative to the mounting bracket.

Another aspect of various examples of the present disclosure relates to a ceiling fan mounting assembly that includes a ceiling fan box, a mounting bracket, and a fastener connecting the mounting bracket to the ceiling fan box. Moving the fastener translates the ceiling fan box relative to the mounting bracket.

According to another aspect of various examples of the present disclosure, there is provided a mounting bracket supporting a ceiling fan and ceiling fan box. The mounting bracket comprises a substantially planar body that has a first section and a second section. The mounting bracket also comprises an upper support surface that extends substantially perpendicularly with respect to the body. The first section is configured to be secured to the ceiling fan box. The upper support portion is configured to contact a first surface of a ceiling support. The second section is configured to contact a second surface of a ceiling support.

Another aspect of various examples of the present disclosure relates to a ceiling fan mounting assembly that comprises a ceiling fan box configured to be positioned at least partially through an opening in a ceiling. The ceiling fan box includes a riser portion configured to be positioned within the ceiling in use, and a flange that extends at least partially around an outer perimeter of the riser portion. The flange is configured to rest on a surface of the ceiling. The ceiling fan mounting assembly also comprises a mounting bracket that includes a base portion with an opening and an upper support portion projecting from the base portion. The mounting bracket is configured to connect to the ceiling fan box where the base portion contacts the flange and the opening extends at least partially around the outer perimeter of the riser portion.

Another aspect of various examples of the present disclosure relates to a mounting bracket for supporting a ceiling fan and ceiling fan box. The mounting bracket comprises a base portion comprising a first portion, an opening, and a second portion. The first portion has a pair of side edges and a front edge that extends at least partially between the pair of side edges. The opening is formed between the pair of side edges and the front edge and extends through the base portion toward the front edge. The second portion is integrally formed with the base portion and is connected to the front edge. The second portion extends away from the opening. The mounting bracket also includes an upper support portion integrally formed with the base portion and connected to the front edge between the first portion and the second portion. The opening is configured to at least partially surround a perimeter of the ceiling fan box. The upper support portion is configured to engage a joist in a ceiling. The second portion is configured to engage a second surface of the joist in the ceiling.

Another aspect of various examples of the present disclosure relates to a ceiling fan mounting assembly that includes a ceiling fan box and a mounting bracket. The ceiling fan box can be positioned at least partially through an opening in a ceiling. The ceiling fan box includes a riser portion that can be positioned within the ceiling in use. The riser portion includes a channel with a partially enclosed perimeter. The mounting bracket has a base portion with an opening and a mounting finger that extends away from the base portion. The mounting bracket can connect to the ceiling fan box where the opening extends at least partially around the outer perimeter of the riser portion. The mounting finger is received within the channel and can translate within the channel as the mounting bracket moves relative to the ceiling fan box.

Another aspect of various examples of the present disclosure relates to a mounting bracket for supporting a ceiling fan and ceiling fan box that includes a base portion and an upper support portion. The base portion includes a first portion with an opening, a mounting finger connected to the first portion, and a second portion. The mounting finger can extend over the opening. The second portion is integrally formed with the first portion. The second portion extends away from the opening. The upper support portion is integrally formed with the base portion. The opening can at least partially surround a perimeter of the ceiling fan box. The mounting finger can be received within a channel of the ceiling fan box. The upper support portion can engage a first surface of a joist in a ceiling. The second portion can engage a second surface of the joist in the ceiling.

Another aspect of various examples of the present disclosure relates to a method of mounting a ceiling fan that comprises positioning a mounting bracket at least partially around a perimeter of a box proximate to a lower surface of the box; and securing the mounting bracket to the box.

Another aspect of various examples of the present disclosure relates to a method of mounting a ceiling fan that comprises orienting an opening of a mounting bracket above a ceiling fan box and sliding the mounting bracket at least partially around the box.

Another aspect of various examples of the present disclosure relates to a method of mounting a ceiling fan that comprises orienting a mounting bracket beside a ceiling fan box and moving the mounting bracket at least partially around the box. The ceiling fan box includes a riser portion extending in a first direction and the mounting bracket is moved in a second direction substantially perpendicular to the second direction.

Another aspect of various examples of the present disclosure relates to a method of mounting a ceiling fan that comprises orienting a mounting bracket having an opening with a box so that the shape of the mounting bracket corresponds to the shape of the box; sliding the mounting bracket at least partially around the box; securing the mounting bracket to the box; positioning a portion of the mounting bracket against a ceiling joist; and securing the mounting bracket to the ceiling joist.

Another aspect of various examples of the present disclosure relates to a method of mounting a ceiling fan that comprises orienting a mounting bracket having an opening with a box; moving the mounting bracket at least partially around the box; securing the mounting bracket to the box; positioning a portion of the mounting bracket against a first surface of a ceiling joist and against a second surface of the ceiling joist; and securing the mounting bracket to the first and second surfaces of the ceiling joist.

Another aspect of various examples of the present disclosure relates to a method of mounting a ceiling fan in a ceiling, the method comprising: positioning an opening of a mounting bracket proximate to a ceiling fan box; moving the mounting bracket so that the opening at least partially receives an outer perimeter of the ceiling fan box; and moving the mounting bracket into contact with a first surface of a ceiling support and a second surface of the ceiling support perpendicular to the first surface.

Another aspect of various examples of the present disclosure relates to a method of mounting a ceiling fan in a ceiling, the method comprising aligning an opening of a mounting bracket with an outer perimeter of a ceiling fan box, the opening including at least one projection and the ceiling fan box including at least one complementary recess for receiving the projection; positioning the mounting bracket at least partially around the outer perimeter so that the at least one projection is received within the at least one complementary recess, the mounting bracket contacting a flange of the ceiling fan box that is configured to contact a surface of the ceiling; inserting a first fastener through aligned openings in the mounting bracket and the flange to secure the mounting bracket to the ceiling fan box; positioning the mounting bracket through an opening in the ceiling proximate to a ceiling joist so that a portion of the mounting bracket contacts the joist; and inserting a second fastener through an aperture on the mounting bracket and into the joist to secure the mounting bracket to the joist.

The disclosure herein should become evident to a person of ordinary skill in the art given the following enabling description and drawings. The drawings are for illustration purposes only and are not drawn to scale unless otherwise indicated. The drawings are not intended to limit the scope of the disclosure. The following enabling disclosure is directed to one of ordinary skill in the art and presupposes that those aspects within the ability of the ordinarily skilled artisan are understood and appreciated.

BRIEF DESCRIPTION OF THE DRAWINGS

Various aspects and advantageous features of the present disclosure will become more apparent to those of ordinary skill when described in the detailed description of preferred examples and reference to the accompany drawing wherein.

DETAILED DESCRIPTION

Figure 1:
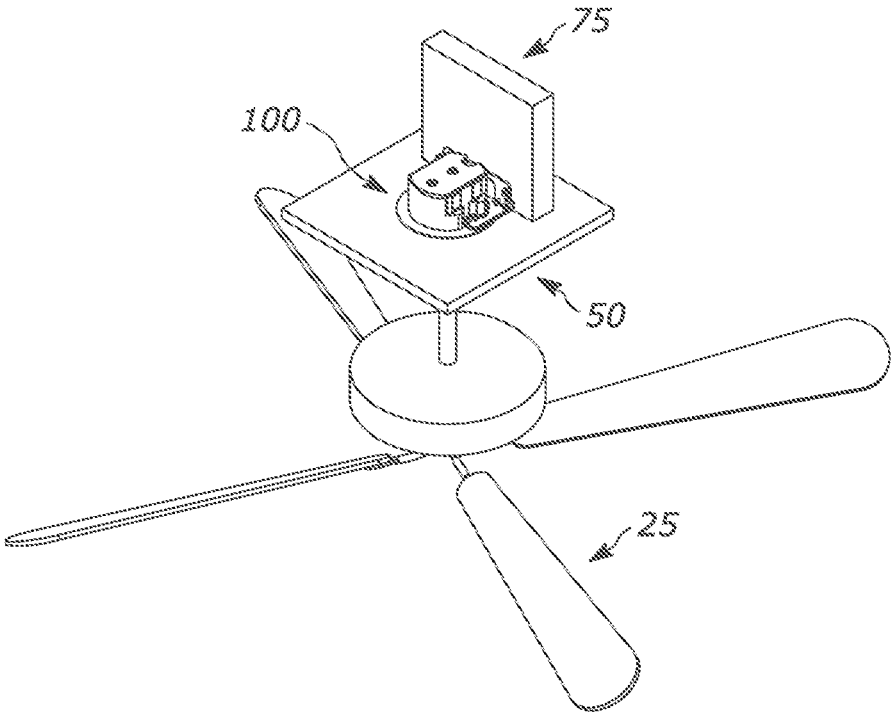
FIG. 1 is a perspective view of a fan mounted in a ceiling using a ceiling mounted assembly.

As shown in FIG. 1, a fan 25 is mounted to a ceiling 50 using a ceiling mounting assembly 100. The ceiling mounting assembly 100 supports the weight and vibrations of the fan 25 while at rest and in use.

Figure 2:
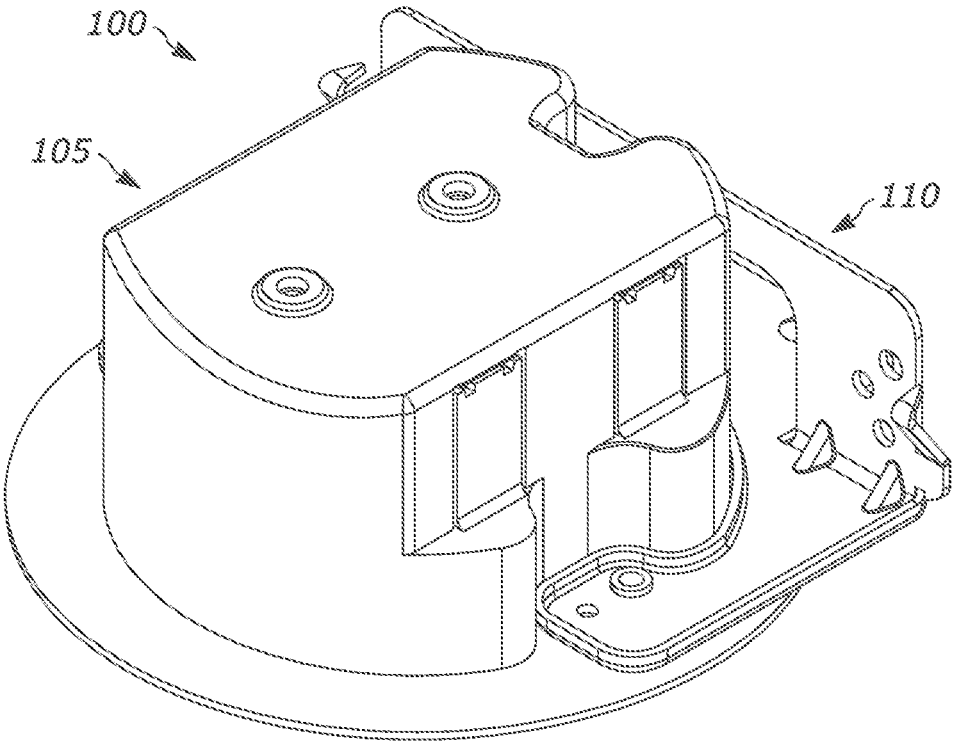
FIG. 2 is a perspective view of the ceiling mounting assembly of FIG. 1.

As shown in FIG. 2, the ceiling mounting assembly 100 includes a ceiling fan box 105 and a mounting bracket 110. The ceiling fan box 105 can support electronic components (e.g., electronic wiring) that are connected to the fan 25 (e.g., to power the fan and/or lights). The mounting bracket 110 can be coupled to the ceiling fan box 105 in order to support the ceiling fan box 105 and the fan 25 above the ceiling 50.

FIGS. 3 to 9 illustrate the ceiling fan box 105 that is part of the ceiling mounted assembly 100. The ceiling fan box 105 includes a bottom flange 115 and a riser portion 120 that extends from the bottom flange 115. The bottom flange 115 may be substantially circular in shape, although other shapes (e.g., elliptical, triangular, rectangular, etc.) may also be used. The illustrated bottom flange 115 also extends completely around the perimeter of the riser portion 120, although other examples may include one or more bottom flanges 115 that extend only partially around the perimeter of the riser portion 120.

In some forms, the flange 115 may include at least one aperture 125. The illustrated bottom flange 115 includes four apertures 125 (see e.g., FIGS. 5 and 7), although any number may be included on the flange 115. The illustrated flange 115 also includes a pair of the apertures 125 on either side, where one aperture 125 in each pair is larger than the other aperture 125 in the respective pair. The larger diameter aperture 125 on one side may be aligned with the smaller diameter aperture 125 on the opposite side of the flange 115 so that the apertures 125 are not symmetric, although in other examples the same diameter apertures 125 may be aligned. In other examples, the number of apertures 125 may be unequally balanced and/or all the apertures 125 may be the same size.

Figure 3:
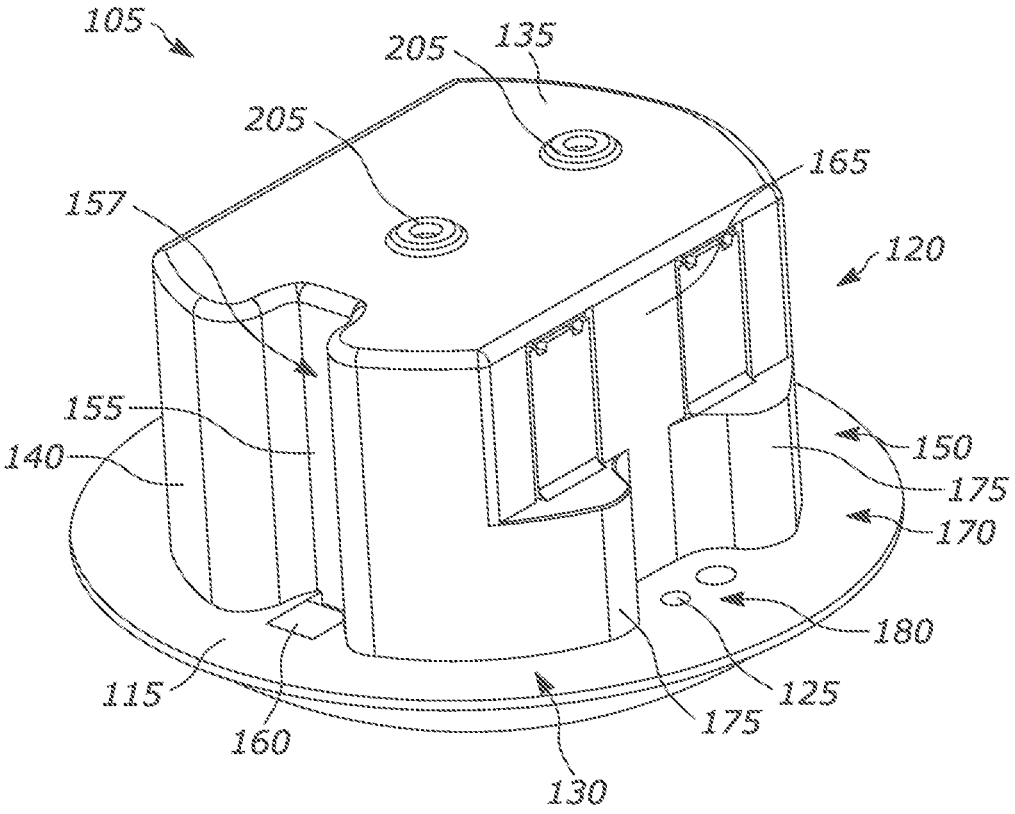
FIG. 3 is a front perspective view of a ceiling fan box of the ceiling mounting assembly of FIG. 1.
Figure 4:
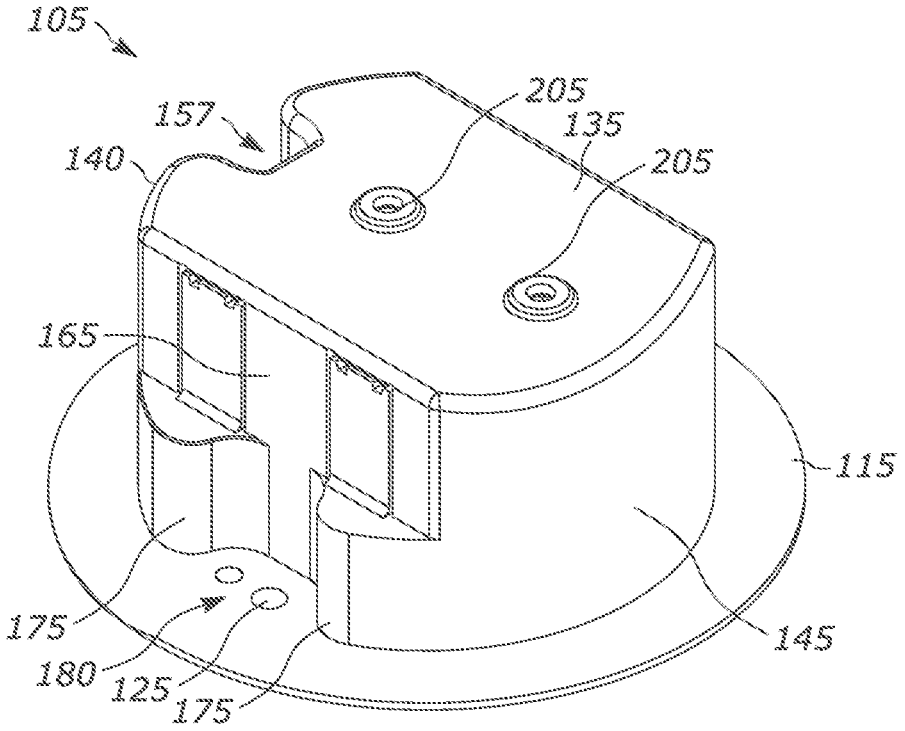
FIG. 4 is a rear perspective view of the ceiling fan box of FIG. 3.

As shown in FIGS. 3 and 4, the riser portion 120 includes side walls 130 that extend from the flange 115 to an upper surface 135. In the illustrated example, the side walls 130 are at least partially curved and the upper surface 135 is substantially planar. Although in other examples the side walls 130 and/or the upper surface 135 may be a different shape (e.g., curved).

In some forms, the side walls 130 include a front wall 140, a rear wall 145, and a pair of side walls 150. The side walls 150 are disposed opposite to one another and extend between the front wall 140 and the rear wall 145.

Figure 6:
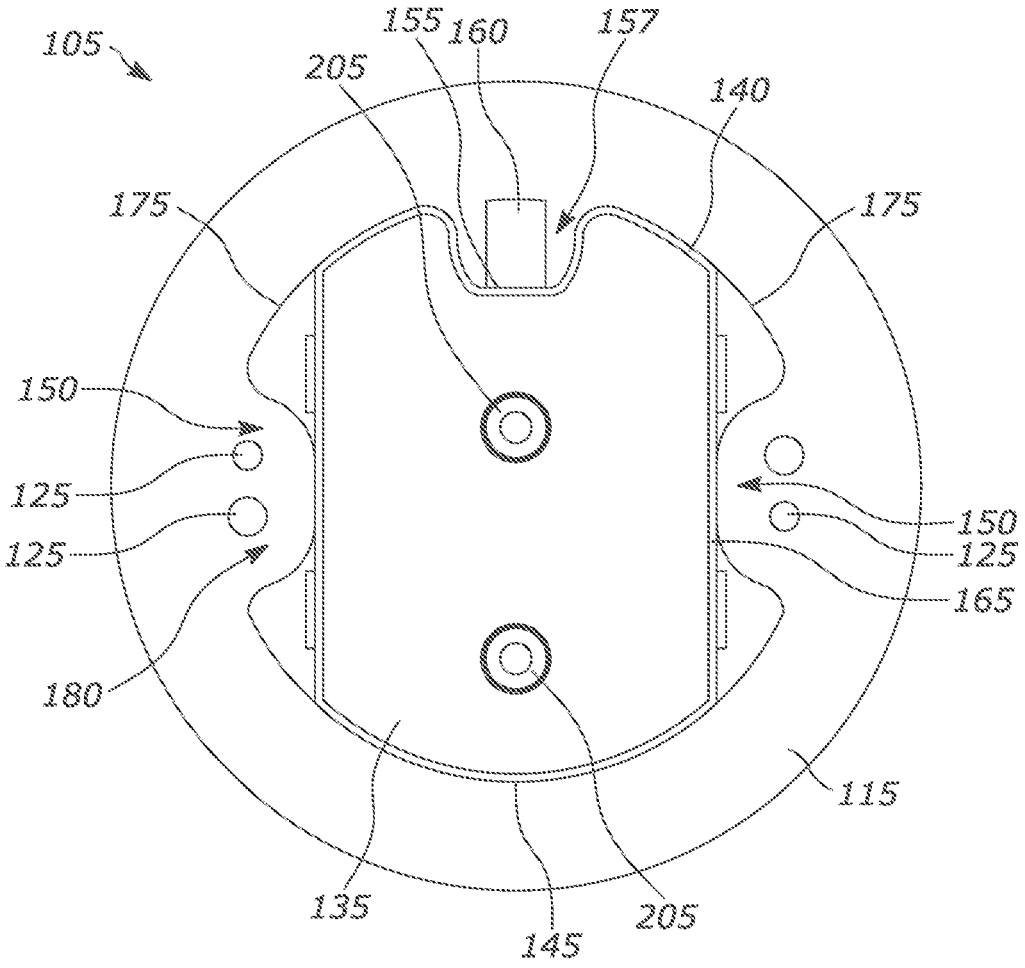
FIG. 6 is a top view of the ceiling fan box of FIG. 3.

As shown in FIG. 6, the illustrated rear wall 145 includes a curved surface that extends between the pair of side walls 150. The rear wall 145 is illustrated with a constant radius of curvature, although different radii of curvature may be used.

With continued reference to FIG. 6, the illustrated front wall 140 also includes a curved surface and may have substantially the same radius of curvature as the rear wall 145. However, the curve in the front wall 140 may not be continuous between the pair of side walls 150. The front wall 140 may include a substantially stepped surface 155 in a channel 157 that extends toward the center of the riser portion and forms a discontinuity along the otherwise continuous curvature of the front wall 140. The stepped surface 155 may be substantially planar, although other shapes (e.g., concave or convex) may be used.

In some forms, the flange 115 may include a slot 160 proximate or adjacent to the stepped surface 155. The illustrated slot 160 is substantially rectangular in shape, although any other shape may be used (e.g., circular, elliptical, triangular, etc.). The slot 160 may have a width (e.g., measured along the stepped surface 155) that is approximately the same (e.g., slightly less than) the width of the stepped surface 155. The slot 160 may also have a length (e.g., measured substantially perpendicular to the stepped surface 155) that extends to about the outer radius of the front surface 140.

Returning to FIGS. 3 and 4, each of the side walls 150 may include an upper portion 165 and a lower portion 170. The upper portion 165 may be substantially planar and may be oriented substantially perpendicularly with respect to the upper surface 130. The lower portion 170 may project radially outwardly from the upper portion 165 and may be curved.

The illustrated lower portion 170 may include two curved portions 175 that are spaced apart from one another. Each curved portion 175 may be a continuation of one of the front or rear walls 140, 145. For example, the radius of curvature of each curved portion 175 may be substantially equivalent to the radius of curvature of the adjacent one of the front wall 140 or the rear wall 145.

A groove 180 may be formed between each pair of curved portions 175 on either side of the riser portion 120. Each pair of apertures 125 may be disposed through the surface of the flange 115 in a region within one of the grooves 180.

As shown in FIGS. 7 to 10, the ceiling fan box 105 may include a lower projection 185 that may extend from a surface of the flange 115 in an opposite direction from the riser portion 120. For example, the flange 115 may be disposed in between the riser portion 120 and the lower projection 185.

In the illustrated example, the lower projection 185 may be substantially circular in shape, although other shapes may be used. The lower projection 185 may include a smaller diameter than the riser portion 120, although in other examples the lower projection 185 may include an outer diameter that is equal to or greater than the outer diameter of the riser portion 120.

Figure 5:
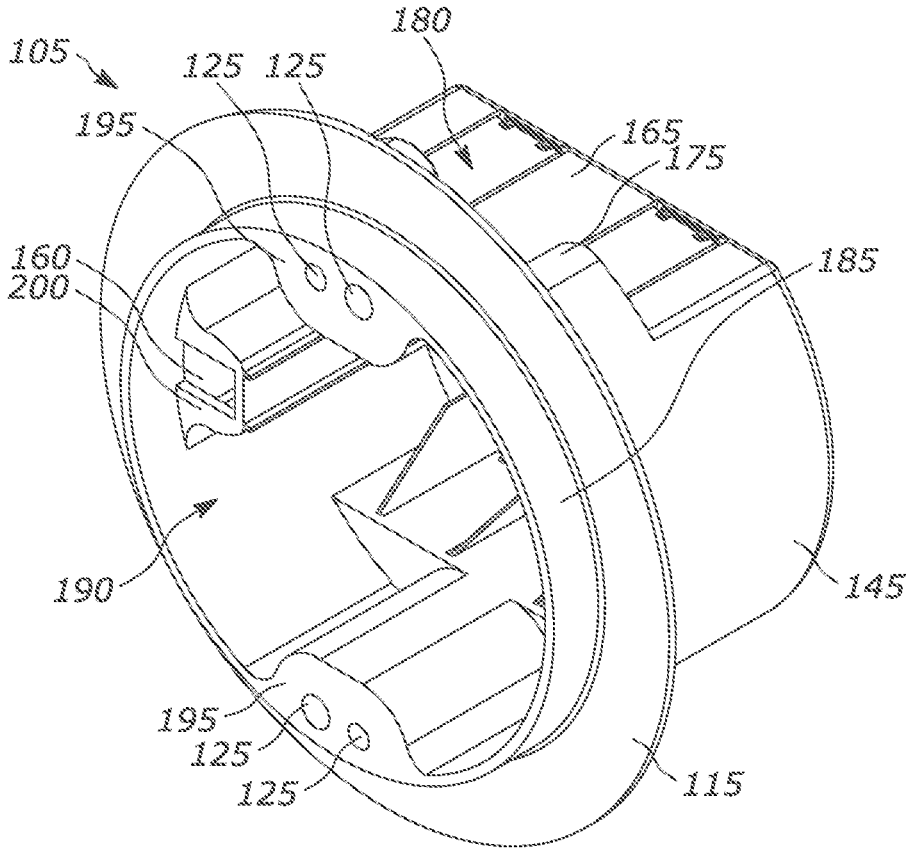
FIG. 5 is a bottom perspective view of the ceiling fan box of FIG. 3.

As shown in FIG. 5, the inner diameter of the lower projection 185 forms a cavity 190 through a center of the ceiling fan box 105. In some examples, the cavity 190 may extend through substantially all the ceiling fan box 105 (e.g., into the riser portion 120) so that the ceiling fan box 105 is at least partially hollow.

Figure 7:
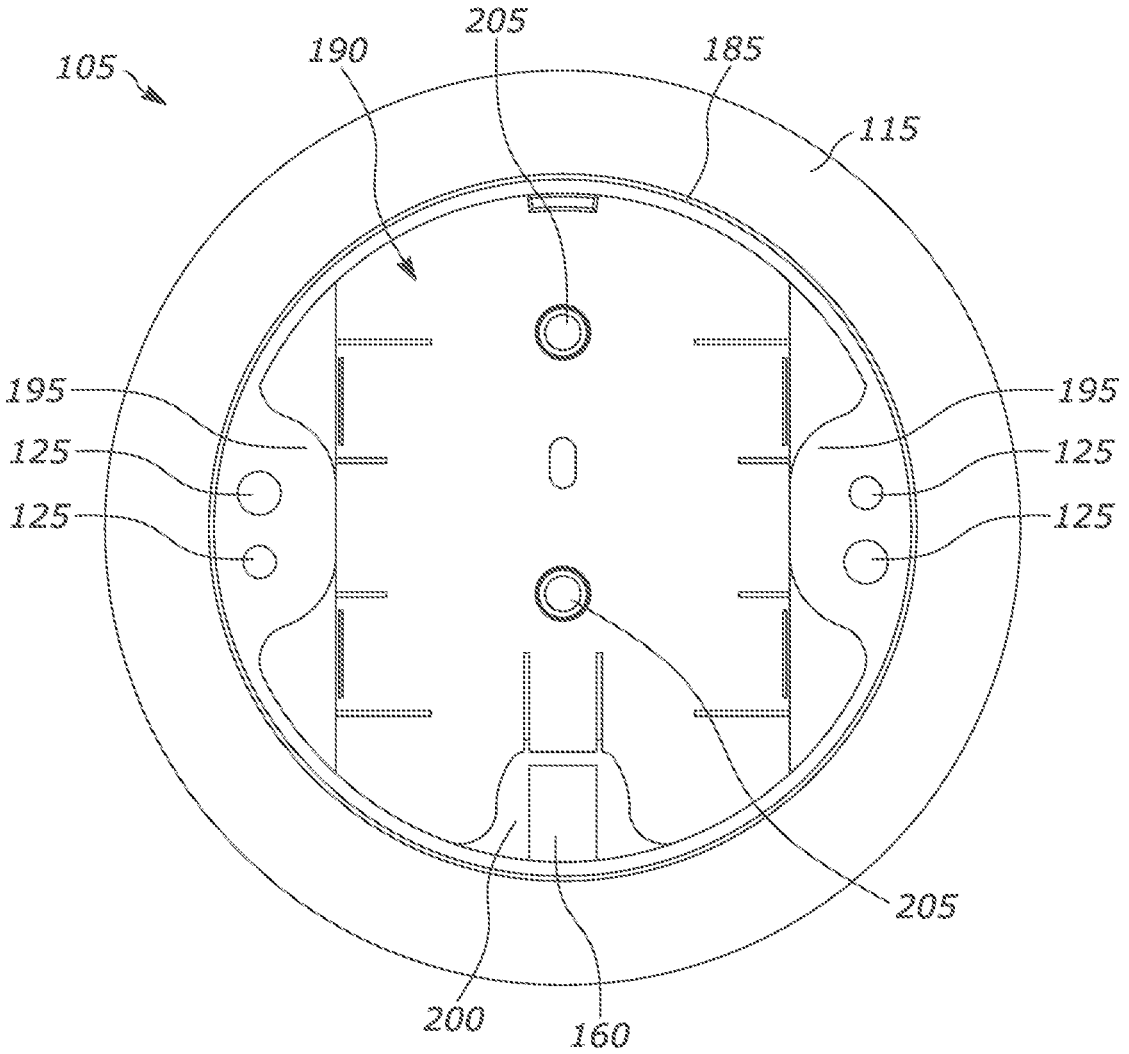
FIG. 7 is a bottom view of the ceiling fan box of FIG. 3.
Figure 8:
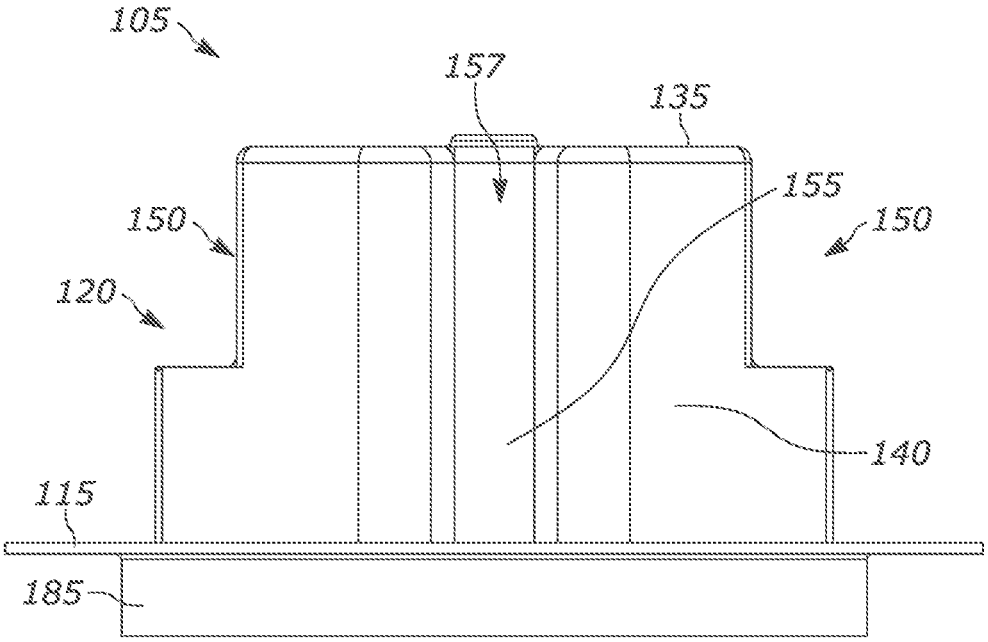
FIG. 8 is a front view of the ceiling fan box of FIG. 3.
Figure 9:
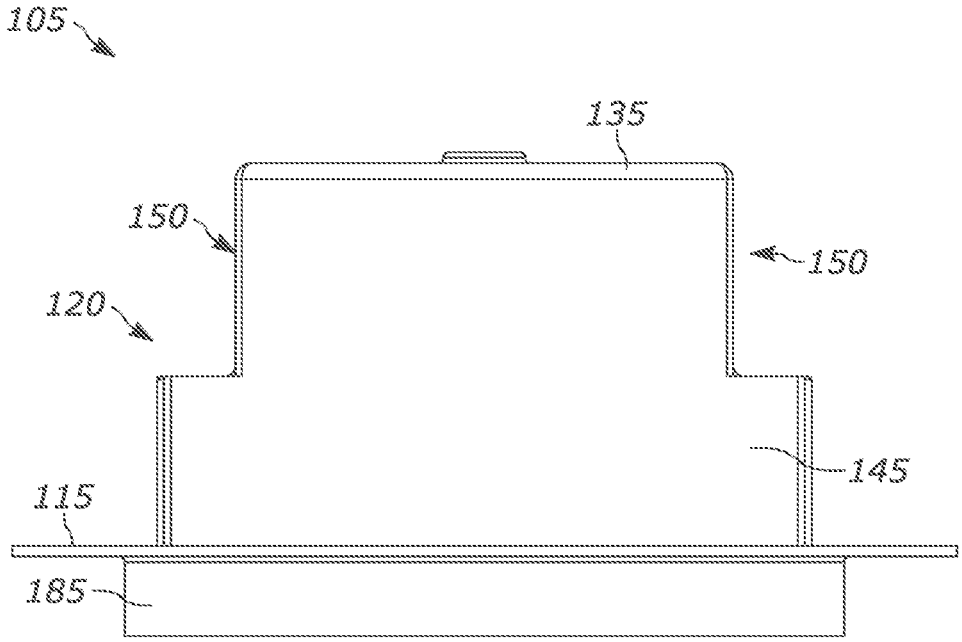
FIG. 9 is a rear view of the ceiling fan box of FIG. 3.
Figure 10:
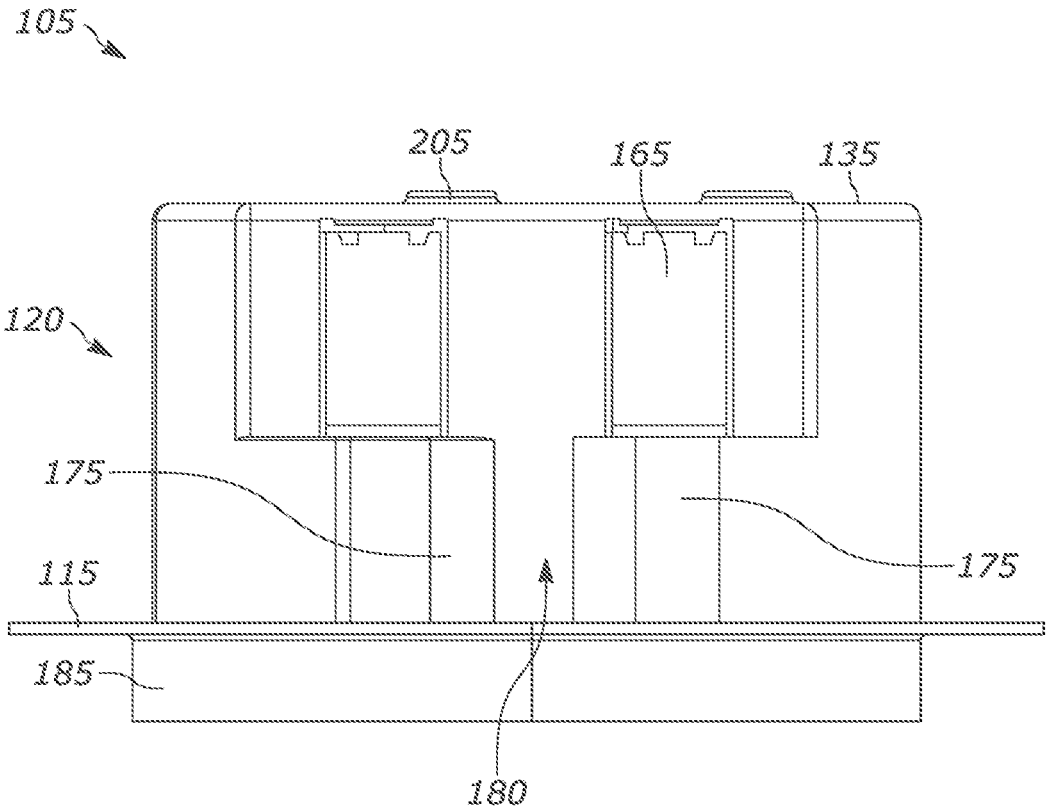
FIG. 10 is a side view of the ceiling fan box of FIG. 3.

As shown in FIG. 7, a pair of first protrusions 195 may extend from the inner surface of the lower projection 185. The first protrusions 195 may be aligned on opposite sides of the ceiling fan box 105. In some forms, the apertures 125 may extend through the protrusions 195.

FIG. 7 also illustrates a second protrusion 200. In the illustrated example, the second protrusion 200 may be disposed between the pair of first protrusions 195. In some forms, the second protrusion 200 may be disposed an equal distance between each of the first protrusions 195 (e.g., about 90° apart), although in other examples the second protrusion 200 may be closer to one of the first protrusions 195.

In some forms, the second protrusion 200 may include a shape that is substantially similar to the shape of the groove 157. The slot 160 may extend from the flange 115 to the lower projection 185 through the second protrusion 200.

With continued reference to FIG. 7, at least one opening 205 (e.g., two shown) may be disposed at an end of the cavity 190. The openings 205 may extend through the upper surface 135.

In some forms, the ceiling fan box 105 may be constructed at least partially from a non-metallic material. For example, the ceiling fan box 105 may be constructed entirely from plastic, although in other examples, portions of the ceiling fan box 105 may be metallic. Constructing the ceiling fan box 105 from a non-metallic material may assist in reducing the overall weight of the ceiling mounting assembly 100.

Figure 11:
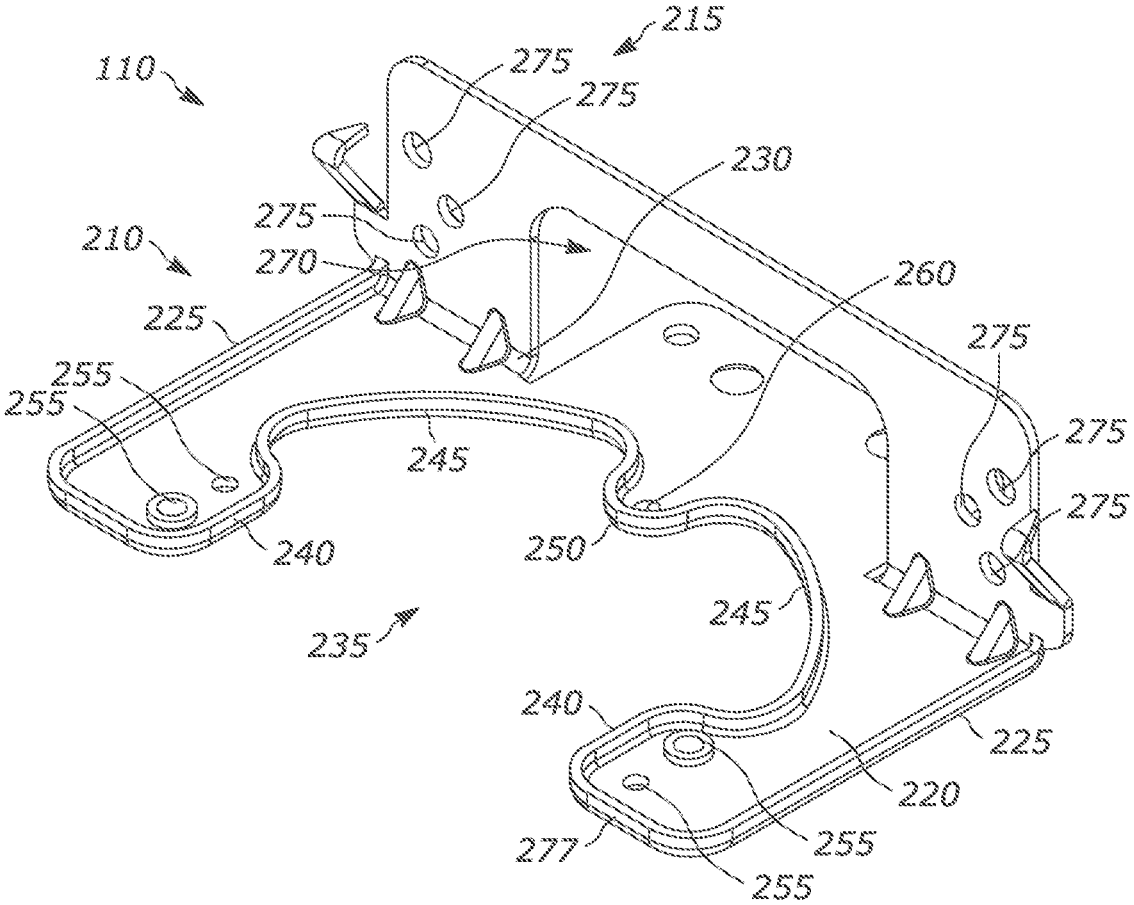
FIG. 11 is a perspective view of a bracket of the ceiling mounting assembly.
Figure 12:
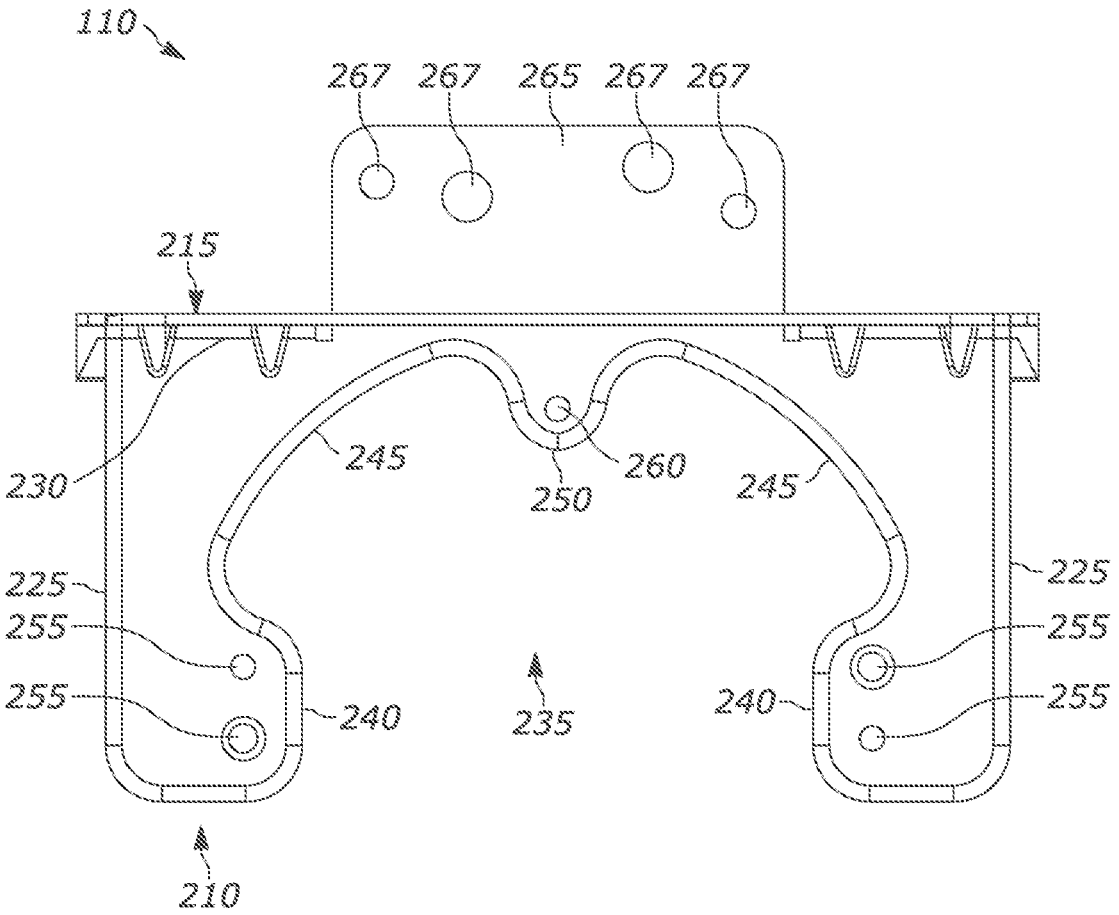
FIG. 12 is a top view of the bracket of FIG. 11.

FIGS. 11 and 12 illustrate the mounting bracket 110 that is part of the ceiling mounted assembly 100. The mounting bracket 110 includes a base portion 210 and an upper support portion 215 that extends from the base portion 210. In the illustrated example, the base portion 210 and the upper support portion 215 are oriented approximately perpendicularly with respect to one another. In other examples, the upper support portion 215 may be inclined with respect to the base portion 210 (e.g., oriented at an angle other than 90°).

In some forms, the base portion 210 may include a first section 220 with a substantially C-shape or U-shape. For example, the first section 220 may include a pair of side edges 225 and a front edge 230. As shown in FIG. 12, the side edges 225 may be substantially parallel to one another and the front edge 230 may be substantially perpendicular to the side edges 225.

The base portion 210 may include an opening 235 between the pair of side edges 225. For example, the opening 235 may extend into the base portion toward the front edge 230 so that an opening to the opening 235 is distal to the front edge 230.

The shape of the opening 235 may be substantially like the shape of at least a portion of the riser portion 120. For example, a pair of planar edges 240 may be disposed proximate to the entrance of the opening 235. A curved region 245 may be disposed adjacent to each planar edge 240. A protruding portion 250 may be disposed between the two curved regions 245. The protruding portion 250 may be disposed proximate to a center of the opening 235 so that each curved region 245 is substantially the same size and shape. This orientation may form a forked-region (e.g., because of the protruding portion 250 being spaced apart from the planar edges 240 and the side edges 225).

The opening 235 may include a different shape if a differently shaped riser portion 120 is used. For example, the radius of curvature of the curved regions 245 and/or the presence of the protruding portion 250 may change to better conform to the shape of a different riser portion 120.

In still other examples, the opening 235 may include a shape usable with a variety of shaped riser portions 120. For example, the opening 235 may be at least partially circular (e.g., semi-circular). The partially circular opening 235 may be sized to at least partially extend around the riser portion 120, although it may not snuggle conform to all regions of the illustrated riser portion 120.

In some forms, a pair of apertures 255 may be disposed on the first section 220 proximate to the pair of planar edges 240. Each pair of apertures 255 may be substantially the same size and shape as the pair of apertures 125 on the flange 115. The protruding portion 250 may also include an aperture 260.

In some forms, the base portion 210 includes a second portion 265 that is connected to the first portion 220. For example, the second portion 265 may be connected to the front edge 230 of the first portion 220. As shown in FIG. 12, the length of the second portion 265 may be less than the length of the front edge 230. The second portion 265 may also include at least one aperture 267 (e.g., four shown). The illustrated apertures 267 have different sizes, although all of the apertures 267 may be the same size.

The upper support portion 215 may be connected to the front edge 230 on either side of the second portion 265. The upper support portion 215 may include a U-shape or a C-shape with a central opening 270 that has approximately the same width as the second portion 265. The upper support portion 215 may also include at least one aperture 275. The illustrated apertures 275 (e.g., six shown) may be disposed on either side of the central opening 270.

In some forms, the first and second portions 220, 265 may be formed from a one-piece unitary construction. This connection is illustrated as being substantially planar, although other orientations (e.g., bent) may be used. Additionally, the base portion 210 and the upper support portion 215 may be formed as a one-piece unitary construction. For example, the upper support portion 215 may be bent relative to the base portion 210. In other examples, the upper support portion 215 is initially separate from the base portion 210 and is later connected to the base portion 210 (e.g., using welding).

In some forms, the mounting bracket 110 may be constructed from a metallic material. The metallic material may be resistant to bending or flexing while the ceiling mounting assembly 100 is in use.

In some forms, the mounting bracket 110 may include a lip 277 that extends around at least a portion of the perimeter. For example, the lip 277 may extend around at least a portion of the side edges 225, the planar edges 240, the curved regions 245, and the protruding portion 250. The lip 277 may extend entirely around these regions or only partially around the regions (e.g., with or without discontinuities). The lip 277 may be formed as a resulting the manufacturing process, or may be later bent after the mounting bracket 110 is formed.

In some forms (not shown), the base portion 210 of the mounting bracket 110 may have a different shape. For example, the first portion 220 may not include a C-shape or U-shape. In other words, the planar edges 240 and/or the side edges 225 may not extend to a free end of the first portion 220 and form an opening 235 that does not include a complete perimeter. Instead, the opening 235 may be formed entirely within the first portion 220 so that the opening 235 has a complete perimeter.

Figure 13:
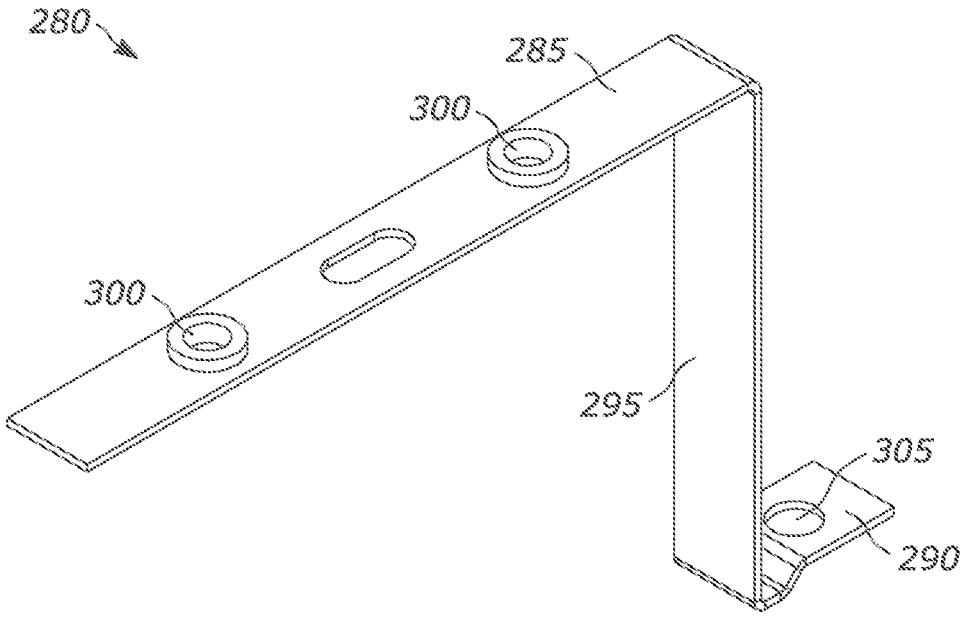
FIG. 13 is a perspective view of a ground bracket of the ceiling mounting assembly.

FIG. 13 illustrates a ground bracket 280 that is also part of the ceiling mounting assembly 100. The ground bracket 280 includes an upper bar 285, a lower bar 290, and a connecting bar 295 extending between the upper and lower bars 285, 290. In the illustrated example, each bar 285, 290, 295 is substantially planar, although one or more bars 285, 290, 295 may be shaped differently (e.g., bent, curved, etc.) in other examples. Additionally, the illustrated connecting bar 295 may be substantially perpendicular to the upper bar 285 and to the lower bar 290. However, the connecting bar 295 may be inclined with respect to the upper bar 285 and/or the lower bar 290 in other examples.

In some forms, the upper bar 285 of the ground bracket 280 includes one or more openings 300 (e.g., two shown). The openings 300 may be spaced apart from one another and may be evenly spaced from the center of the upper bar 285. The lower bar 290 may also include an opening 305.

FIG. 1 shows an in-use position where the ceiling mounting assembly 100 may be positioned within the ceiling 50 to support the fan 25. The ceiling 50 may include an opening through which the ceiling mounting assembly 100 is at least partially received. For example, the lower projection 185 may be inserted through the opening in the ceiling 50 and the flange 115 may rest on the surface of the ceiling 50 when the ceiling mounted assembly 100 is fully installed.

Figure 14:
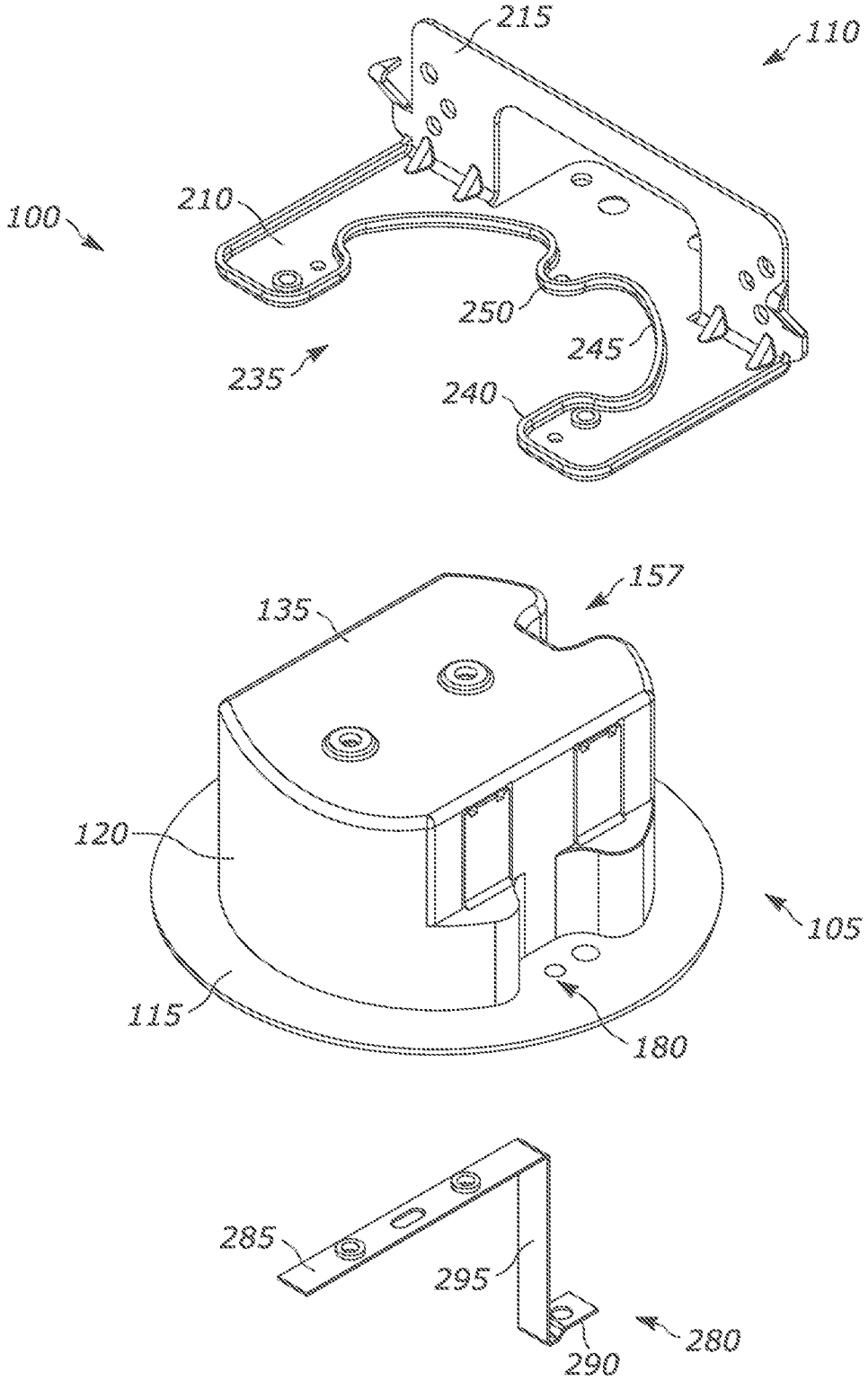
FIG. 14 is an exploded view of the ceiling mounted assembly of FIG. 2.

Prior to mounting the fan 25, the ceiling mounting assembly 100 may be assembled as illustrated in FIG. 14. Specifically, the mounting bracket 110 may be connected to the ceiling fan box 105. To do this, the mounting bracket 110 may be positioned proximate to the ceiling fan box 105 so that the protruding portion 250 is substantially aligned with the channel 157.

In some forms, the protruding portion 250 may have a complementary shape to the channel 157 and may be able to fit within the channel 157. Additionally, the curved regions 245 may have a complementary shape as the front walls 140. For example, one curved region 245 may correspond to one portion of the front wall 140 (e.g., on one side of the channel 157). Each curved region 245 may be larger than the respective portion of the front wall 140. When the protruding portion 250 and the channel 157 are aligned, each curved region may extend toward one of the curved portions 175 of the lower portion 170 of the side wall 150. An end of each curved region 245 may also be complementary with the respective curved portion 175 (e.g., because of a substantially similar radius of curvature). Finally, the planar edges 240 of the mounting bracket 110 may include a substantially complementary shape to the groove 180 between two of the curved portions 175.

Once the mounting bracket 110 is aligned with the ceiling fan box 105 as described above, a technician may move the mounting bracket 110 into a connecting position where the mounting bracket 110 moves from above the upper surface 135 toward the flange 115 (see e.g., FIG. 2). In the connecting position, the protruding portion 250 will be positioned within the channel 157 and each planar edge 240 will be positioned within a respective one of the grooves 180. Additionally, the mounting bracket 110 will rest on the surface of the flange 115 so that it is spaced apart from (e.g., not in contact with) the upper surface 135.

In other examples, the technician may first align the mounting bracket 110 in front of the ceiling fan box 105. For example, the protruding portion 250 may be aligned with the channel 157 and the planar edges 240 are positioned proximate to the front wall 140. The technician may then move the mounting bracket 110 toward the ceiling fan box 105 so that the planar edges 240 move past the front wall 140 and into the grooves 180 (e.g., with a snap-fit). As this occurs, the protruding portion 250 may be received within the channel 157. This may be used with the distance between the planar edges 240 are larger than the width of the riser portion 120 and/or when the first portion 220 is at least partially constructed from a resilient material.

In still other examples where the ceiling fan box 105 lacks a flange 115, the technician may first align the mounting bracket 110 below the ceiling fan box (e.g., proximate to the cavity 190) and move the mounting bracket 110 up into the connected position.

The mounting bracket 110 may be snuggly connected to the ceiling fan box 105 in this position (e.g., even without the use of fasteners). For example, the complementary shape of the opening 235 and the outer perimeter of the riser portion 120 may limit relative rotational movement between the mounting bracket 110 and the ceiling fan box 105. Positioning the protruding portion 250 within the channel 157 and the planar edges 240 within the respective groove 180 limits relative rotation of the mounting flange 110 and helps to maintain its position.

In this position illustrated in FIG. 2, openings on the mounting bracket 110 may be aligned with openings on the ceiling fan box 105. For example, the apertures 125 on the flange 115 may be aligned with the apertures 255 of the mounting bracket 110 when each planar edge 240 is disposed within the respective groove 180. Additionally, the slot 160 of the flange 115 may be aligned with the aperture 260 when the protruding portion 250 is disposed within the channel 157.

Returning to FIG. 14, the ground bracket 280 may also be connected to the ceiling fan box 105. Specifically, the ground bracket 280 may be positioned within the cavity 190 to connect to the ceiling fan box 105.

For example, the ground bracket 280 may be positioned so that the upper bar 285 is positioned proximate to the upper surface 135 and the lower bar 290 is disposed proximate to the flange 115. When positioned within the cavity 190, the upper bar 285 may be oriented so that the openings 300 are aligned with the openings 205 in the upper surface 135. Similarly, the opening 305 in the lower bar 190 may be aligned with the slot 160.

When these elements are aligned, one or more fasteners may be used to connect the ceiling mounting assembly 100 together. For example, first fasteners 310 may be inserted through the aligned openings 300 to connect the ground bracket 280 to the ceiling fan box 105. A second fastener 315 may be inserted through the aligned opening 305 and the slot 160 to provide further connection between the ground bracket 280 and the ceiling fan box 105. In some examples, only one first fastener 310 may be used and/or only one of the first fastener 310 and the second fastener 315 may be used.

The second fastener 315 may also be inserted through the aperture 260 of the protruding portion 250. For example, the second fastener 315 may be used to connect all the ceiling fan box 105, the mounting bracket 110, and the ground bracket 280 together.

Fasteners may also be used to connect the ceiling fan box 105 and the mounting bracket 110. For example, third fasteners 320 may be inserted through the aligned apertures 125, 255. The illustrated example shows only one third fastener 320 proximate to either planar edge 240 (e.g., so that one of both aperture 125 and aperture 255 in each pair of apertures does not receive a third fastener 320). However, other examples may include fasteners through all the apertures 125, 255.

In the illustrated example, all the fasteners may be inserted into the cavity 190 of the ceiling fan box 105 first when being moved into position. For example, the first fasteners 310 may be inserted through the ground bracket 280 prior to being inserted through the upper surface 135. However, other examples may include one or more fasteners that are inserted into the cavity after passing though another element of the ceiling mounting assembly 100.

Figure 15:
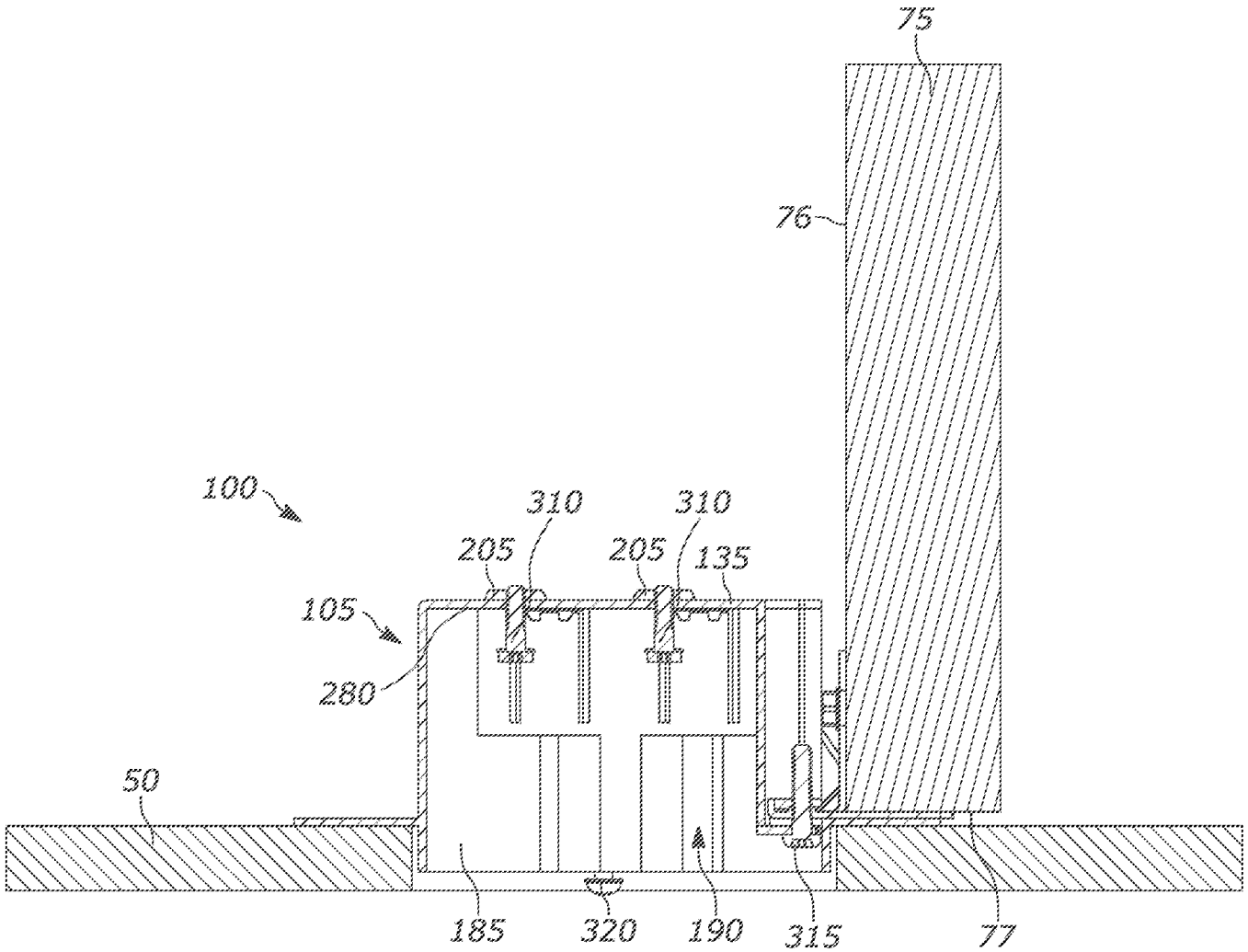
FIG. 15 is a first cross-sectional view of the ceiling mounted assembly of FIG. 2 mounted in a ceiling.

As illustrated in FIG. 15, the ceiling mounted assembly 100 may be positioned within an opening of the ceiling 50 proximate to a support 75 (e.g., an engineering joist). As described in more detail below, the ceiling mounted assembly 100 may be connected to the support 75 in an in-use position.

When positioned within the ceiling 50, the ceiling mounting assembly 100 may be oriented so that the mounting bracket 110 is proximate to the support 75. For example, at least a portion of the mounting bracket 110 may be in contact with the support 75.

With continued reference to FIG. 15, the upper support portion 215 of the mounting bracket 110 may be positioned adjacent to a surface of the support 75. For example, the upper support portion 215 may contact a surface of the support that is substantially perpendicular to the surface of the ceiling 50 that the hole in the ceiling passes through.

Figure 16:
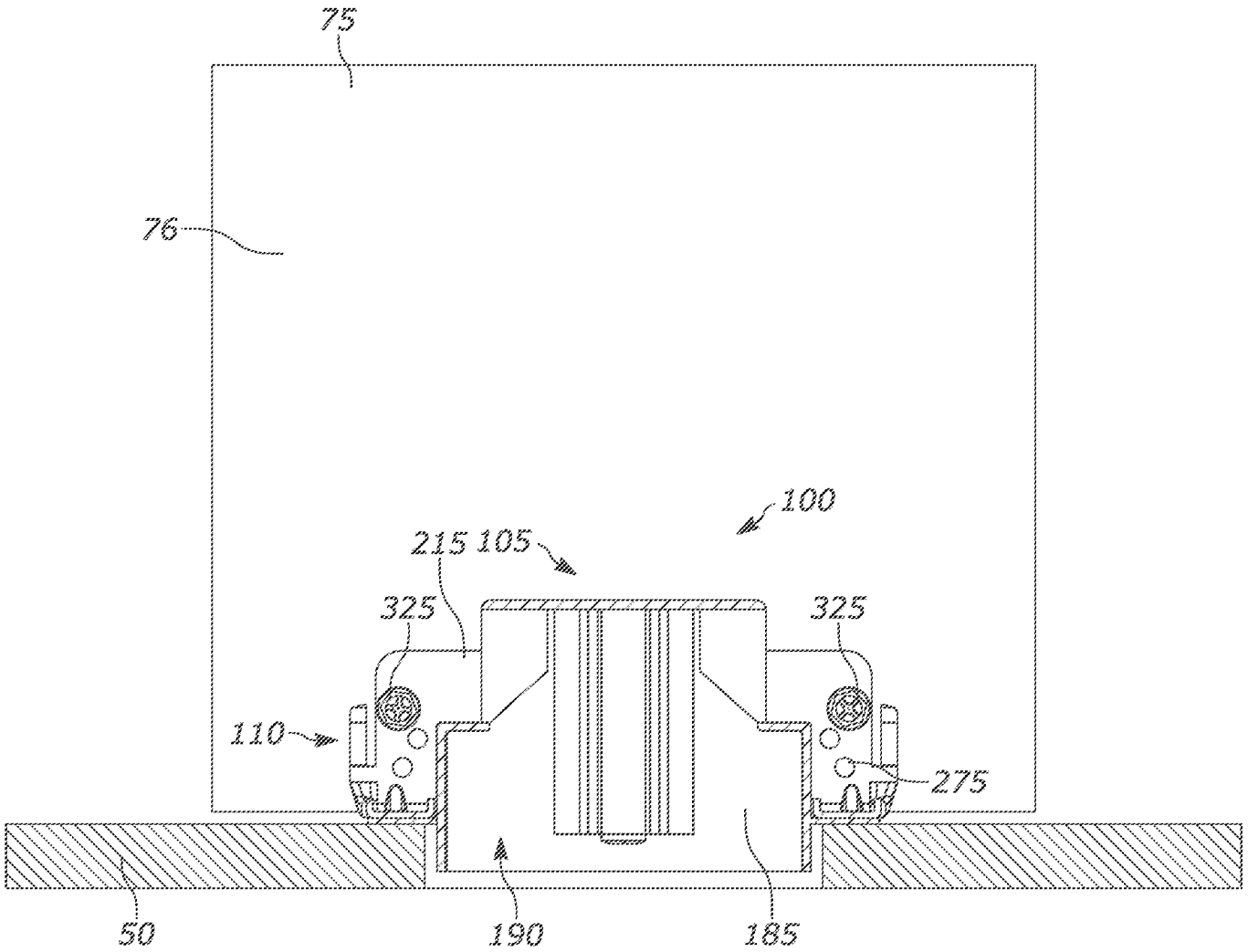
FIG. 16 is a second cross-sectional view of the ceiling mounted assembly of FIG. 2 mounted in a ceiling.

In this position, the apertures 275 of the upper support portion 215 may also be adjacent to the surface of the support 75. As illustrated in FIG. 16, fasteners 325 (e.g., threaded fasteners) may be inserted through one or more of the apertures 275 (e.g., two shown) and into the support 75, which may secure the ceiling mounted assembly 100 relative to the support 75 within the ceiling 50.

The ceiling mounting assembly 100 may also be positioned so that at least a portion of the mounting bracket 110 is disposed between a portion of the ceiling 50 and the support 75. For example, at least a portion of the mounting bracket 110 may be sandwiched between the ceiling 50 and the support 75.

Figure 17:
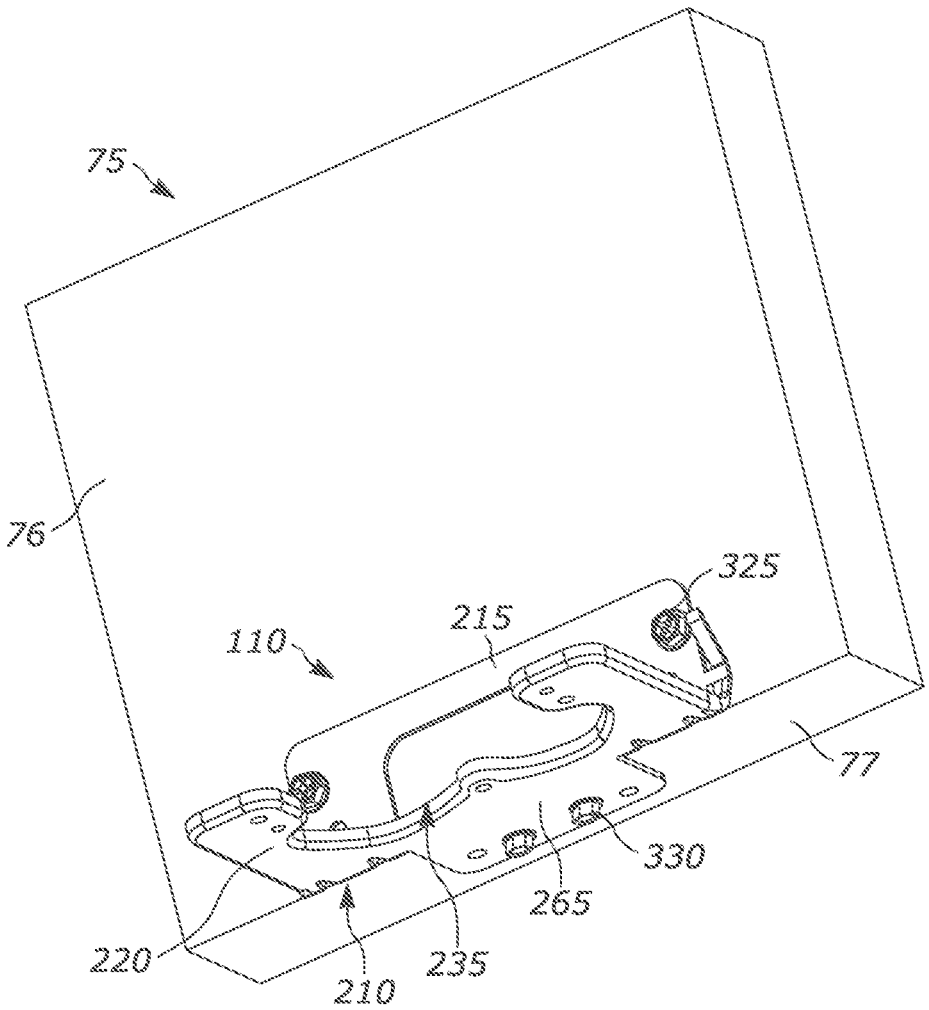
FIG. 17 is a bottom perspective view of the bracket of FIG. 11 connected to a joist.

As shown in FIG. 17, the orientation of the upper support portion 215 and the second portion (e.g., a substantially perpendicular orientation) may allow the mounting bracket 110 to connect to two perpendicular surfaces of the support 75 (e.g., a first surface 76 and a second surface 77 at the same time). For example, the upper support portion 215 may contact a first surface 76 of the support 75 that is oriented substantially perpendicular with respect to the ceiling 50. The second portion 265 may contact a second surface 77 of the support 75 that is substantially parallel to the ceiling 50 (and therefore substantially perpendicular to the first surface 76).

A least one fastener (e.g., threaded fasteners) 330 may be inserted through at least one of the apertures 267 in the second portion 265 to connect the second portion 265 to the support 75. The fastener 330 may be inserted through the respective aperture 267 directly into the surface of the support 75 as a result of the close positioning (e.g., contact) of the second portion 265 relative to the support 75.

Returning to FIG. 15, the second portion 265 of the base portion 210 of the mounting bracket 110 may be at least partially disposed between the ceiling 50 and the support 75. The substantially planar second portion 265 may be parallel with respect to the second surface 77. The incline of the upper support portion 215 relative to the second portion 265 may allow the mounting bracket 110 to sit substantially flush against both surfaces of the support 75.

This orientation may be allowed based on the connected position of the mounting bracket 110 relative to the ceiling fan box 105. For example, by positioning the mounting bracket 110 at a lower end of the ceiling fan box 105 (e.g., proximate to the flange 115), the second portion 265 is disposed proximate to a bottom of the support 75 is able to fit beneath the support 75.

In some forms, at least a portion of the flange 115 may be positioned between the ceiling 50 and the support 75. For example, the second portion 265 may be positioned at least partially against the flange 115. Because the mounting bracket 110 is positioned so that the upper support portion 265 is substantially flush with the support 75, the flange 115 may be at least partially beneath the support 75 when installed. The flange 115 and the second portion 265 may therefore be substantially parallel while in use.

Installing the ceiling mounting assembly 100 in this position may increase the weight that the ceiling mounting assembly 100 can support. For example, connecting the mounting bracket 110 directly to the support 75 (e.g., at the first surface) and/or positioning at least a portion of the mounting bracket 110 beneath the support 75 (e.g., at the second surface 77) provides for a stronger connection (e.g., as compared to a brace that spans two supports 75) because the mounting bracket is connected to two (parallel) surfaces of the support 75. This connection may decrease a moment arm and allow for the connection to a heavier fan 25. Additionally, using fasteners 325 to connect the mounting bracket 110 to the support 75 may provide a stronger connection as compared to connecting the ceiling fan box 105 in a center of a brace. Finally, sandwiching the flange 115 and/or the second portion 265 of the base portion 210 between the ceiling 50 and the support 75 also provides additional resistance to motion and enables the ceiling mounting assembly 100 to support a larger weight.

Figure 18:
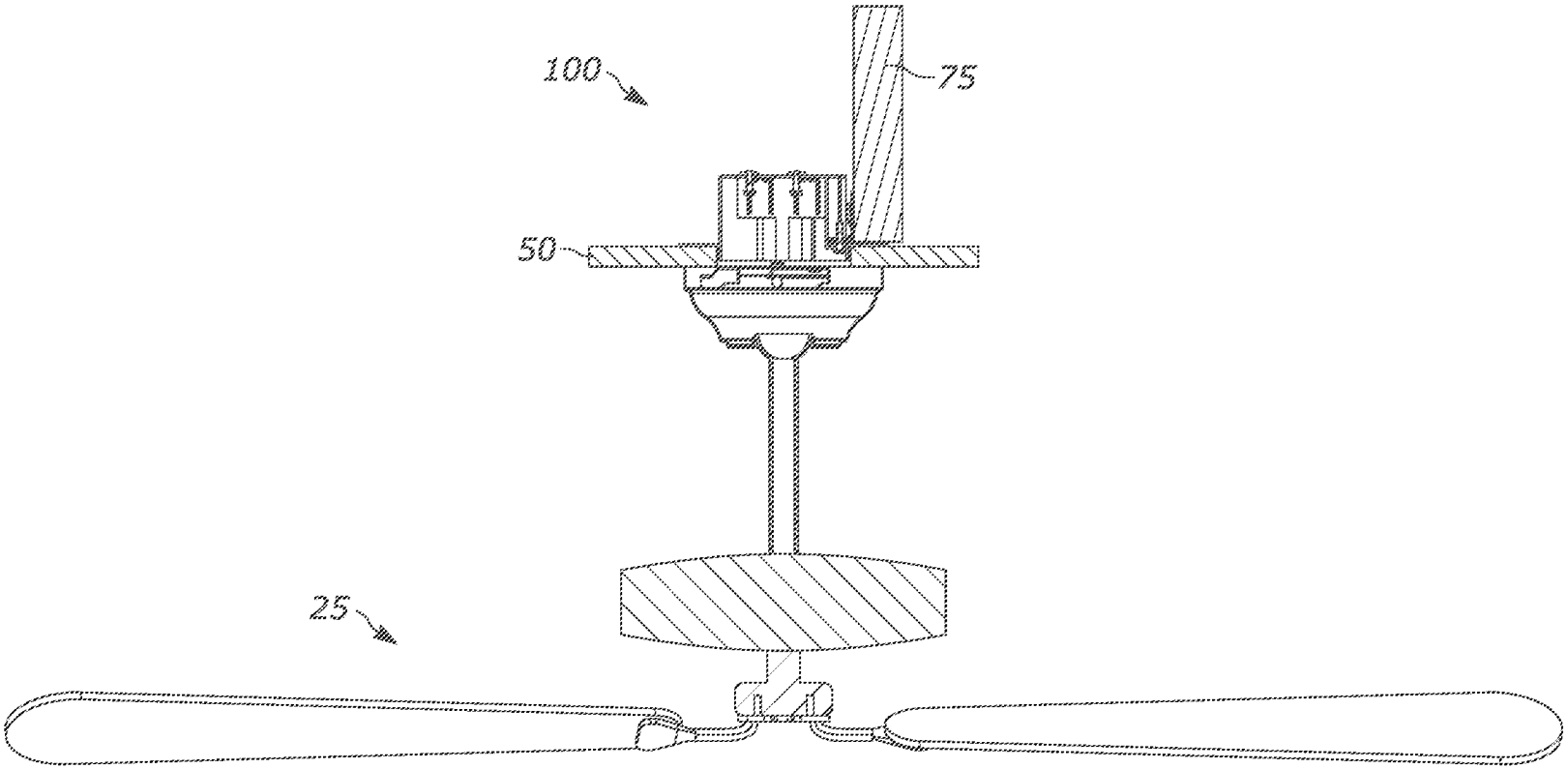
FIG. 18 is a cross-sectional view of the fan mounted to the ceiling.

As shown in FIG. 18, the fan 25 may be connected to the ceiling mounting assembly 100. Specifically, a portion of the fan 25 may be positioned against a surface of the ceiling 50 and connected to the ceiling fan box 105. The mounting bracket 110 (e.g., via its connection to the support 75) can support the weight of the fan 25.

FIGS. 19 to 36 show an alternate example of a ceiling mounted assembly 500, which may be similar to the sealing mounted assembly 100 described above. Similar features may use similar reference numbers, plus "400". Only some similarities and differences between the ceiling mounted assembly 100 and the ceiling mounted assembly 500 are disclosed below.

Figure 19:
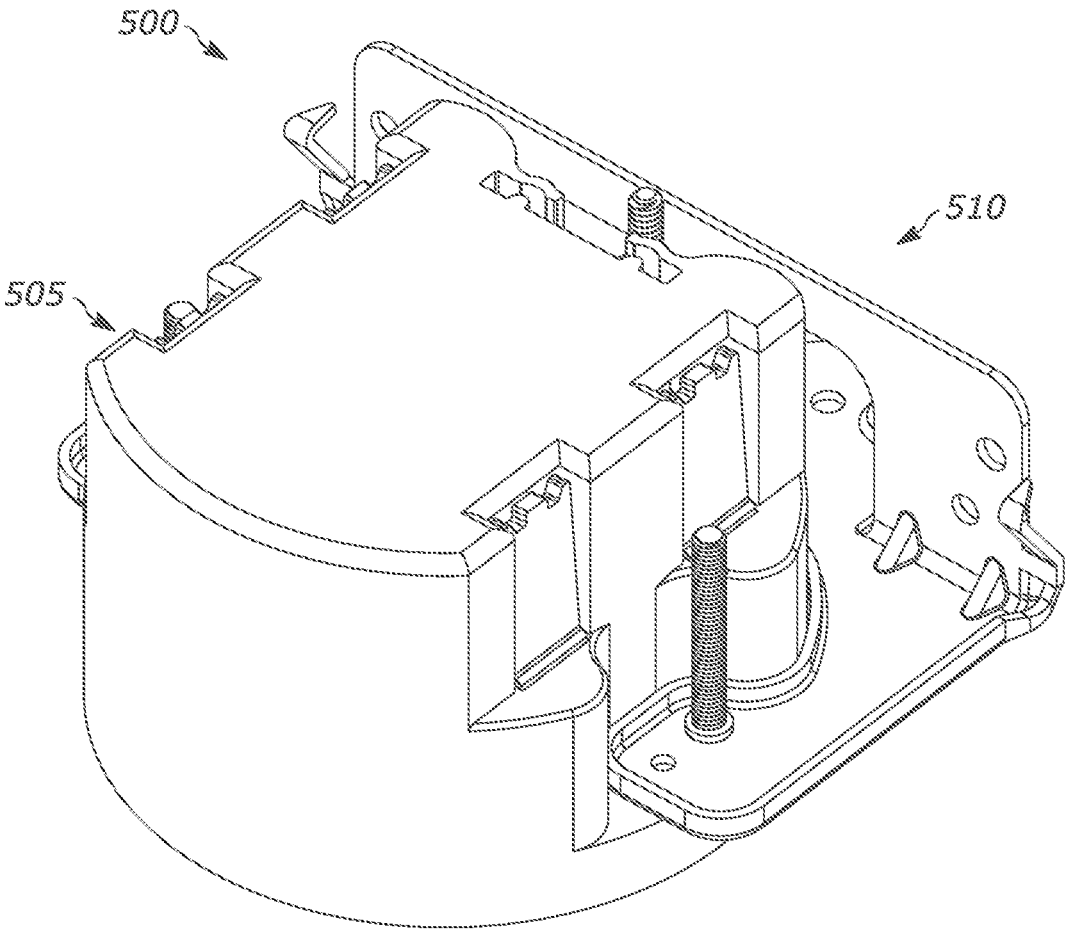
FIG. 19 is a perspective view of the ceiling mounting assembly according to another example.

As shown in FIG. 19, the ceiling mounting assembly 500 includes a ceiling fan box 505 and a mounting bracket 510. The ceiling fan box 505 can support electronic components (e.g., electronic wiring) that are connected to the fan 25 (e.g., to power the fan and/or lights). The mounting bracket 510 can be coupled to the ceiling fan box 505 in order to support the ceiling fan box 505 and the fan 25 above the ceiling 50.

FIGS. 19 to 27 illustrate the ceiling fan box 505 that is part of the ceiling mounted assembly 500. The ceiling fan box 505 includes a bottom flange 515 and a riser portion 520 that extends from the bottom flange 515.

Unlike the bottom flange 115, the bottom flange 515 of the ceiling fan box 505 may not extend around the entire perimeter of the riser portion 520. In other words, the bottom flange 515 may be formed at discrete portions around the perimeter of the riser portion 520.

In some forms, the ceiling fan box 505 may have a constant outer perimeter (e.g., a circular perimeter). Certain portion of the riser portion 520 may extend to the outer perimeter and certain portions of the bottom flange 515 may extend to the outer perimeter. In other words, the bottom flange 515 may not extend radially beyond the outermost perimeter of the riser portion 520. However, other examples may include a bottom flange 515 that extends radially beyond all portions of the riser portion 520.

In some forms, the flange 515 may include at least one aperture 525. The illustrated bottom flange 515 includes two apertures 525 in each section (see e.g., FIGS. 20 and 21), although any number may be included on the flange 515. The illustrated flange 515 also includes a pair of the apertures 525 on either side, where one aperture 525 in each pair is larger than the other aperture 525 in the respective pair. The larger diameter aperture 525 on one side may be aligned with the smaller diameter aperture 525 on the opposite side of the flange 515 so that the apertures 525 are not symmetric, although in other examples the same diameter apertures 525 may be aligned. In other examples, the number of apertures 525 may be unequally balanced and/or all the apertures 525 may be the same size.

Figure 20:
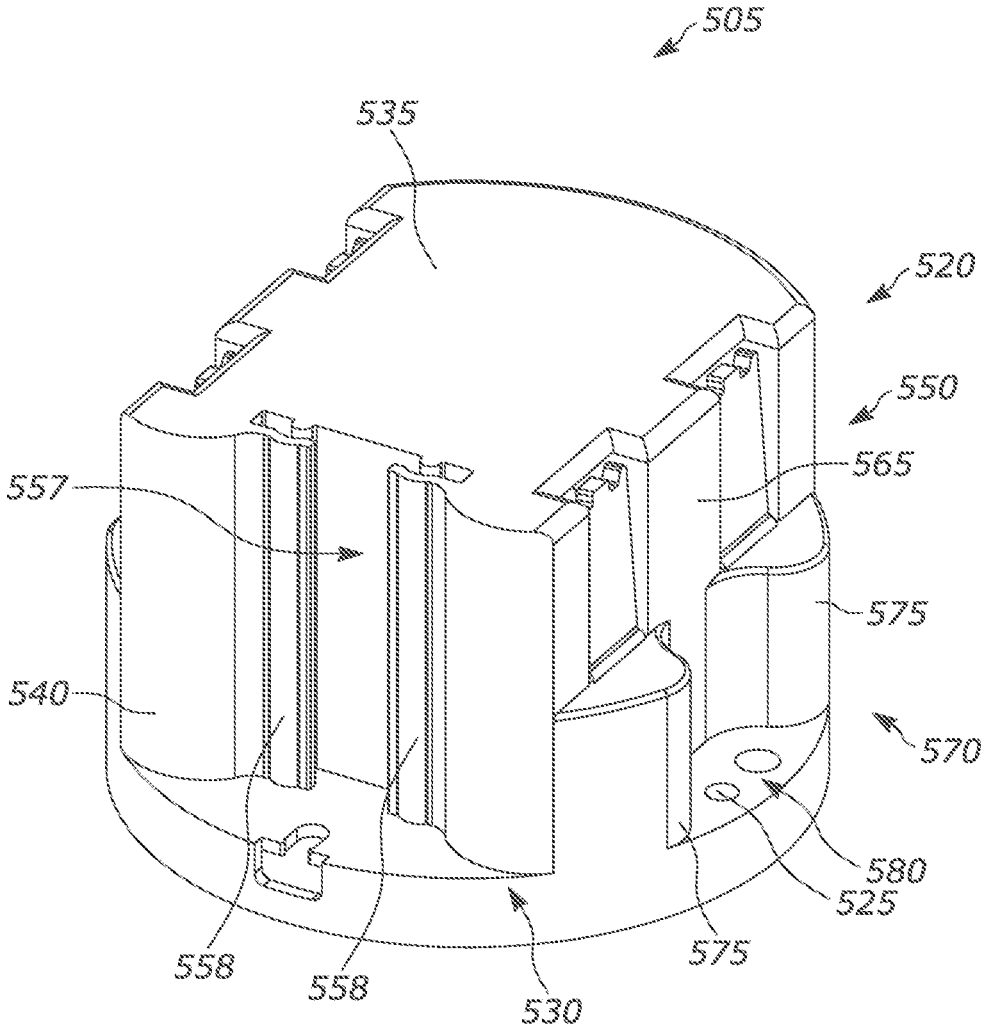
FIG. 20 is a front perspective view of a ceiling fan box of the ceiling mounting assembly of FIG. 19.
Figure 21:
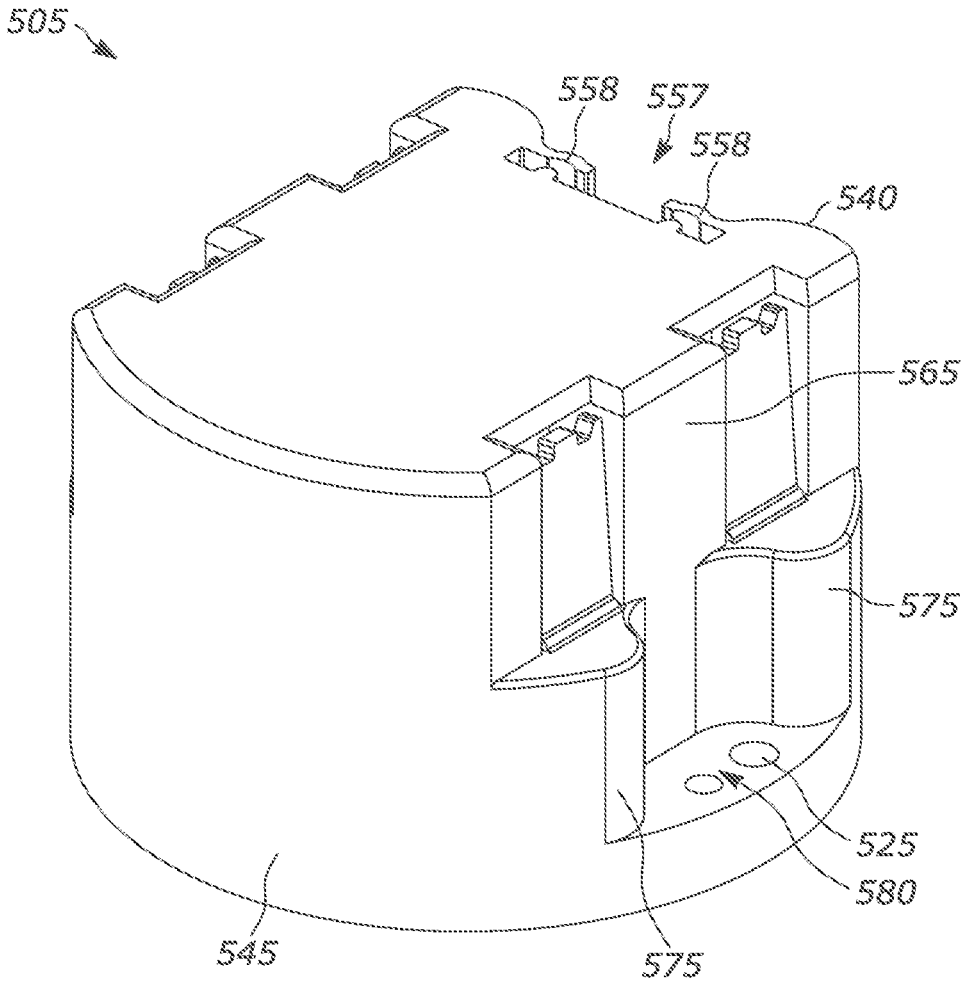
FIG. 21 is a rear perspective view of the ceiling fan box of FIG. 20.
Figure 22:
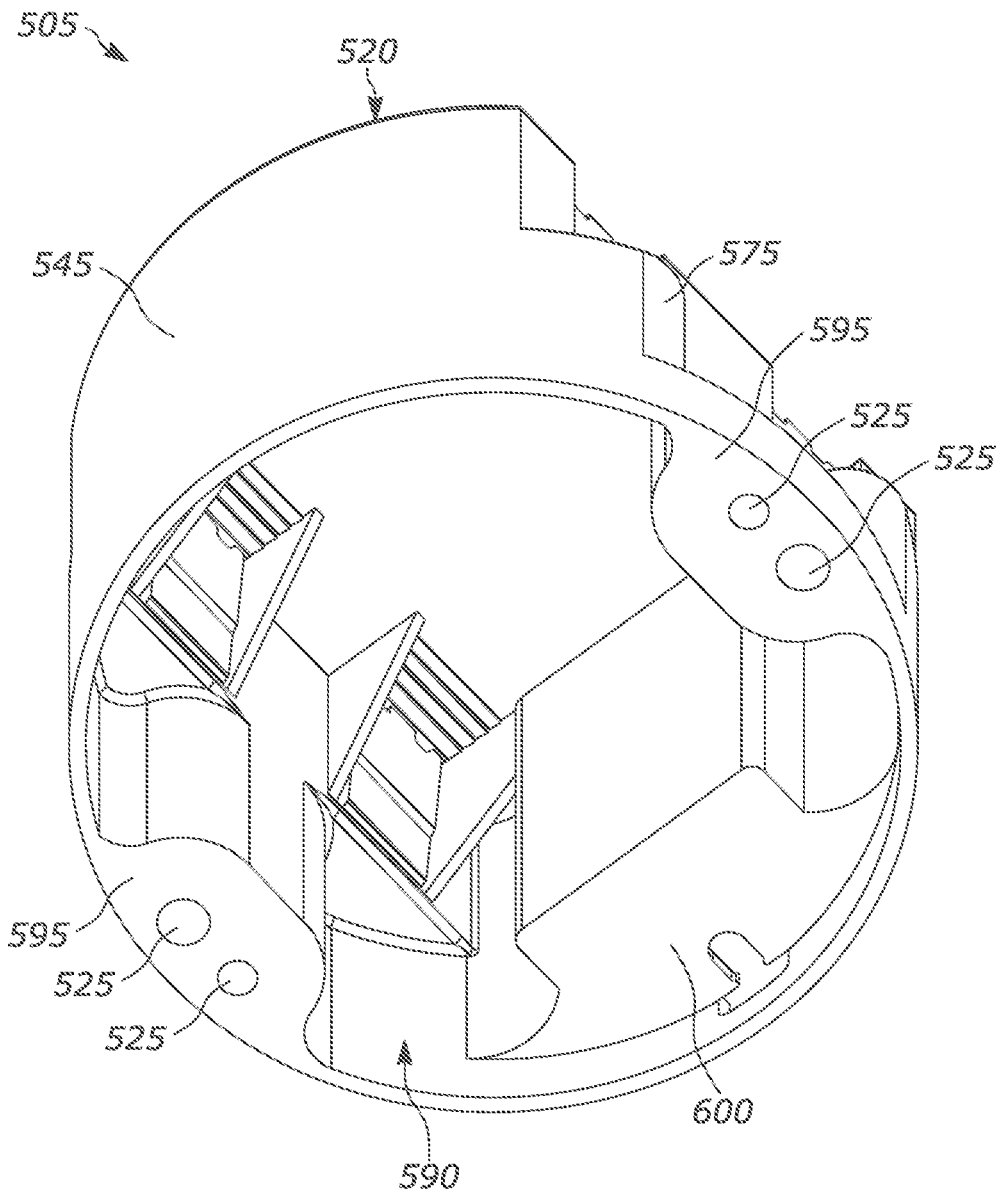
FIG. 22 is a bottom perspective view of the ceiling fan box of FIG. 20.

As shown in FIGS. 20 and 21, the riser portion 520 includes side walls 530 that extend from the flange 515 to an upper surface 535. In the illustrated example, the side walls 530 are at least partially curved and the upper surface 535 is substantially planar. Although in other examples the side walls 530 and/or the upper surface 535 may be a different shape (e.g., curved).

In some forms, the side walls 530 include a front wall 540, a rear wall 545, and a pair of side walls 550. The side walls 550 are disposed opposite to one another and extend between the front wall 540 and the rear wall 545.

Figure 23:
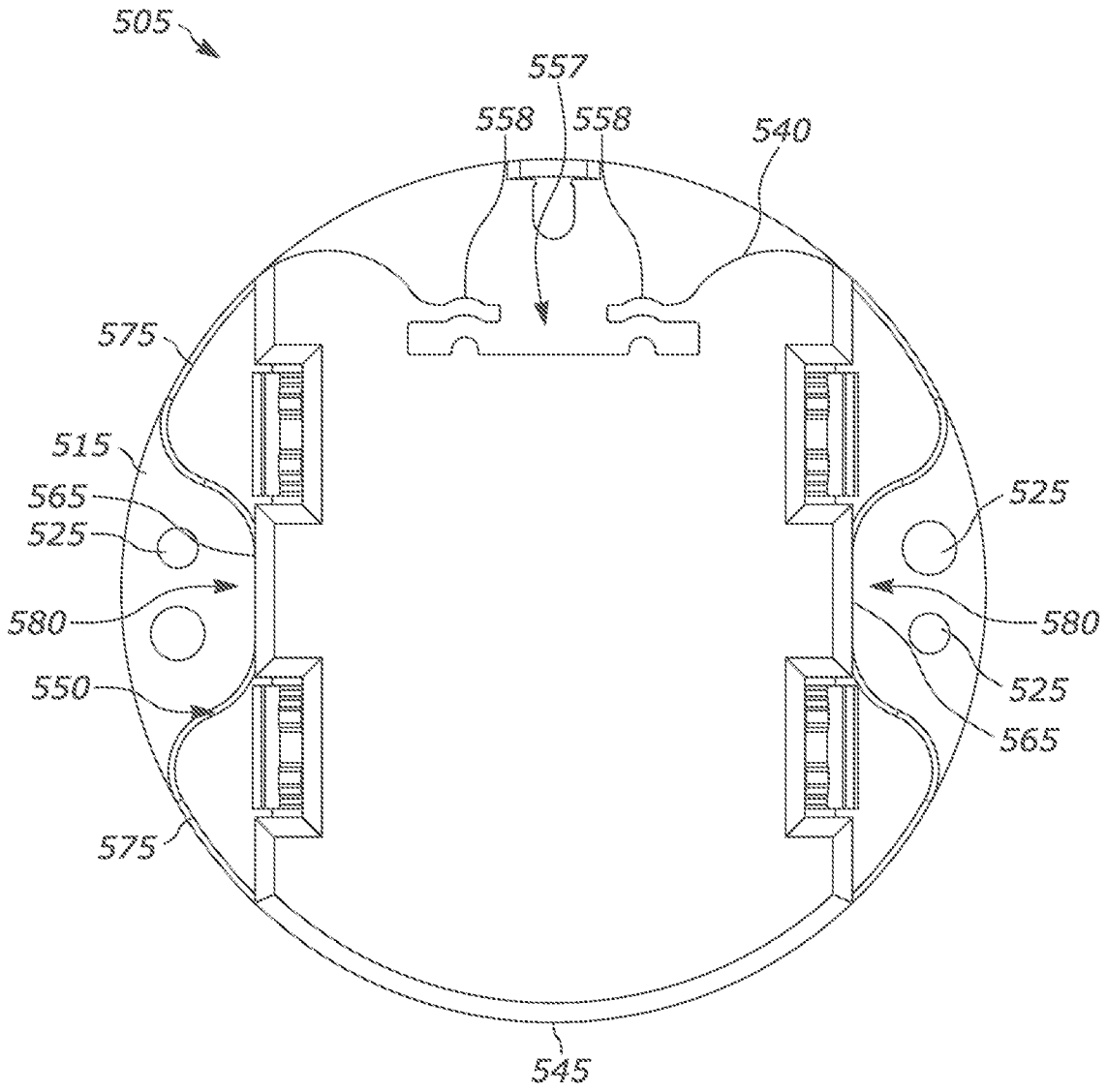
FIG. 23 is a top view of the ceiling fan box of FIG. 20.

As shown in FIG. 23, the illustrated rear wall 545 includes a curved surface that extends between the pair of side walls 550. The rear wall 545 is illustrated with a constant radius of curvature, although different radii of curvature may be used.

With continued reference to FIG. 23, the illustrated front wall 540 also includes a curved surface and may have substantially the same radius of curvature as the rear wall 545. However, the curve in the front wall 540 may not be continuous between the pair of side walls 550. The front wall 540 may include a channel 557 that extends toward the center of the riser portion and forms a discontinuity along the otherwise continuous curvature of the front wall 540.

The channel 557 may be shaped differently than the channel 157. For example, the channel 557 may include fingers 558 that partially enclose a perimeter for the channel 557. In the illustrated example, each finger 558 may extend from the front wall 540 across the channel 557 and toward the other finger 558.

In some forms, the fingers 558 may be spaced apart from one another so that a perimeter of the channel 557 is not entirely enclosed. However, other forms may include a single finger that extends entirely across the channel 557.

Returning to FIGS. 20 and 21, each of the side walls 550 may include an upper portion 565 and a lower portion 570. The upper portion 565 may be substantially planar and may be oriented substantially perpendicularly with respect to the upper surface 530. The lower portion 570 may project radially outwardly from the upper portion 565 and may be curved.

The illustrated lower portion 570 may include two curved portions 575 that are spaced apart from one another. Each curved portion 575 may be a continuation of one of the front or rear walls 540, 545. For example, the radius of curvature of each curved portion 575 may be substantially equivalent to the radius of curvature of the adjacent one of the front wall 540 or the rear wall 545.

A groove 580 may be formed between each pair of curved portions 575 on either side of the riser portion 520. Each pair of apertures 525 may be disposed through the surface of the flange 515 in a region within one of the grooves 580.

As shown in FIG. 23, the inner diameter of the riser portion 520 forms a cavity 590 through a center of the ceiling fan box 505. In some examples, the cavity 590 may extend through substantially all the ceiling fan box 505 (e.g., through substantially all of the riser portion 520) so that the ceiling fan box 505 is at least partially hollow.

Figure 24:
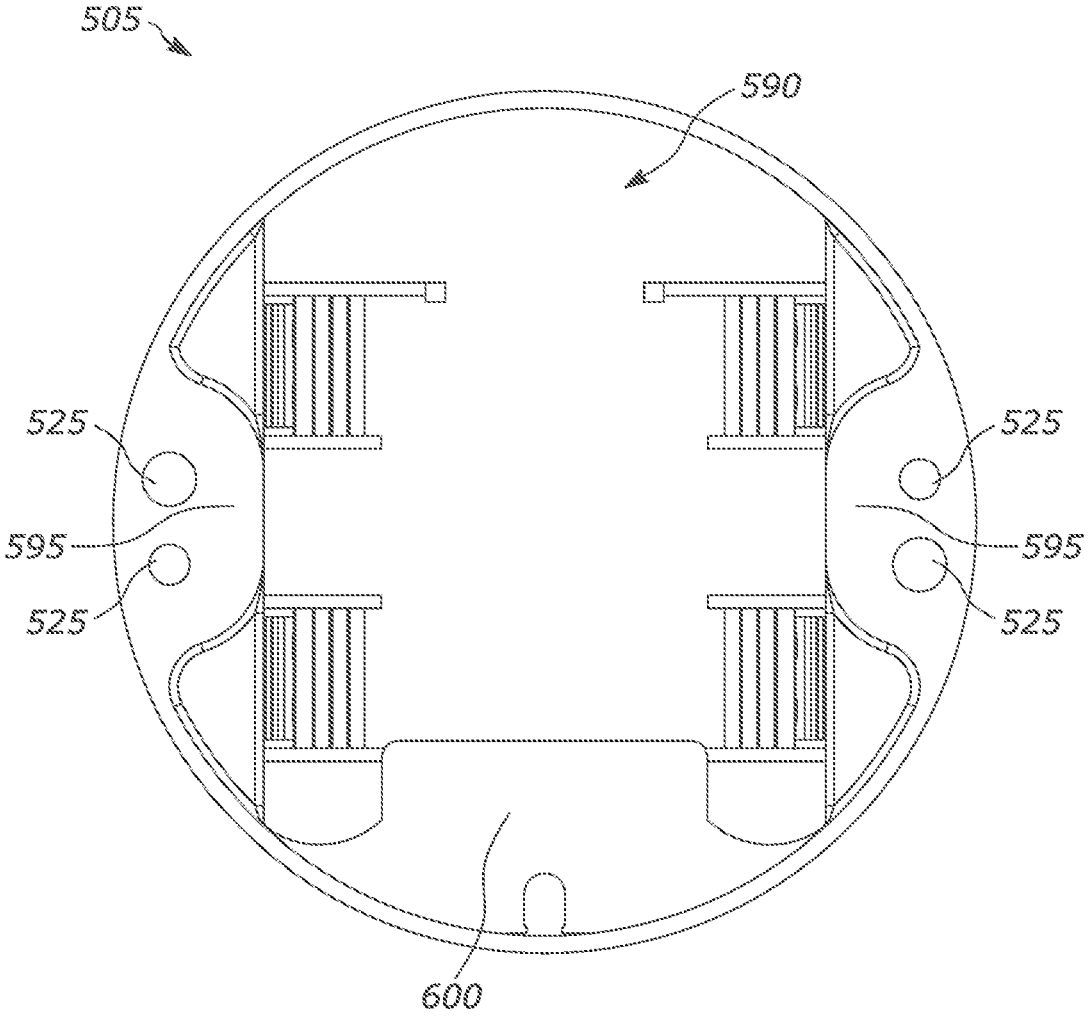
FIG. 24 is a bottom view of the ceiling fan box of FIG. 20.
Figure 25:
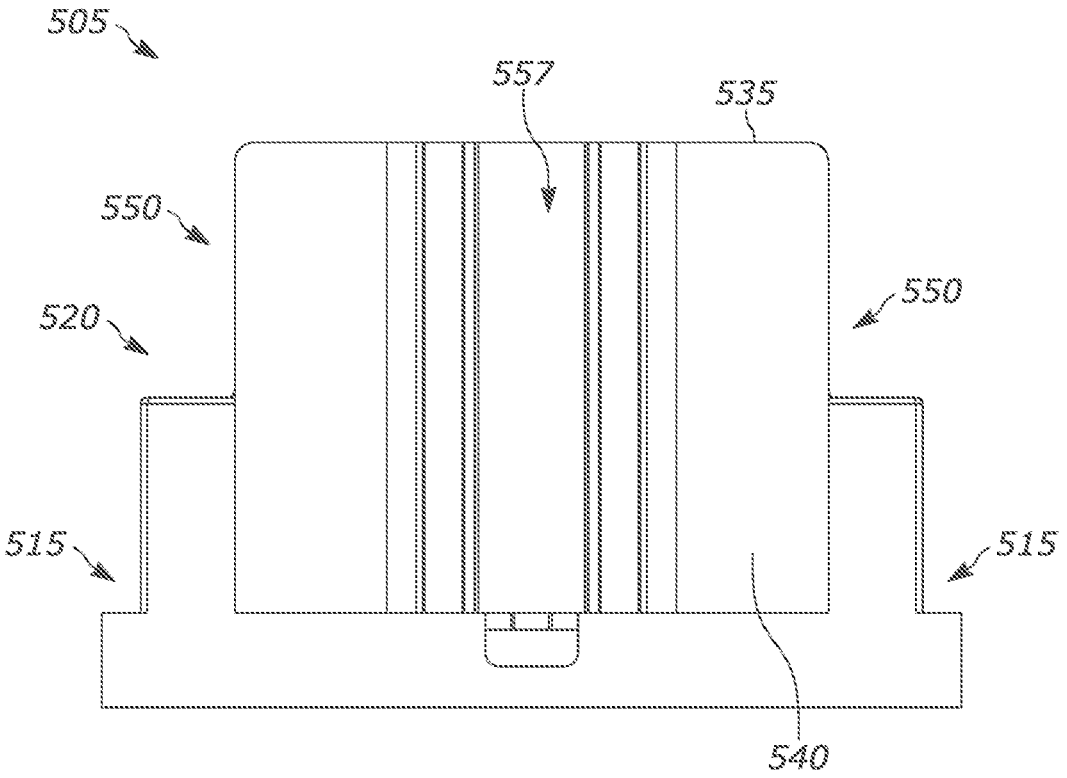
FIG. 25 is a front view of the ceiling fan box of FIG. 20.
Figure 26:
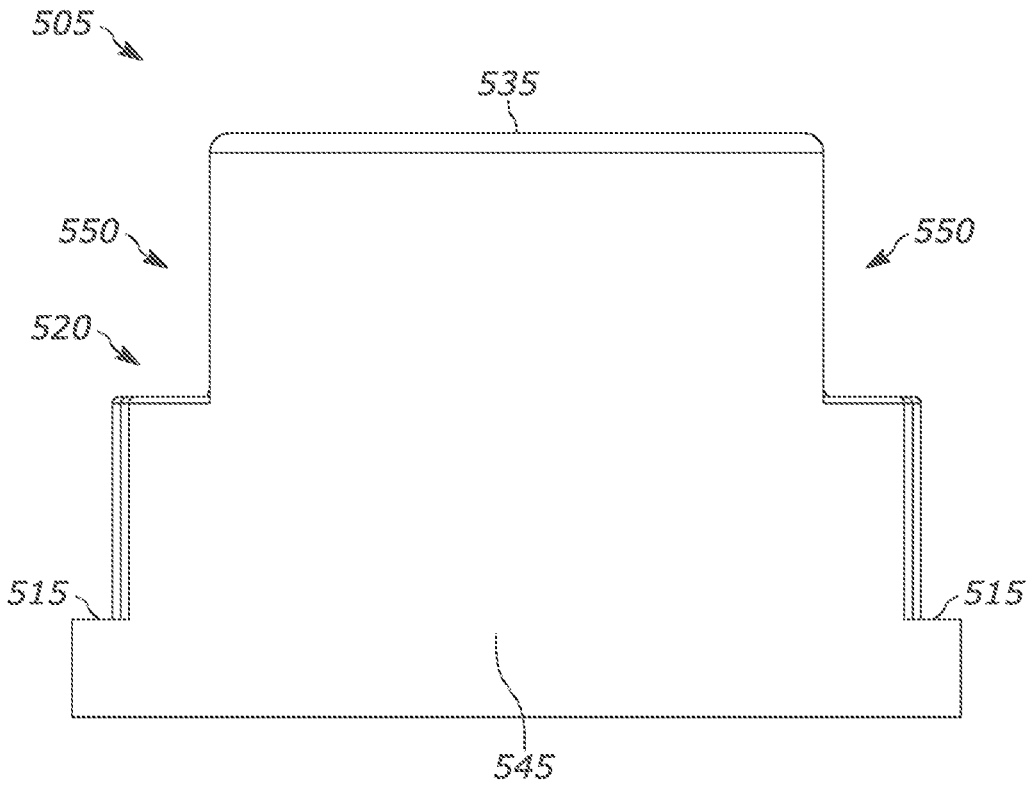
FIG. 26 is a rear view of the ceiling fan box of FIG. 20.
Figure 27:
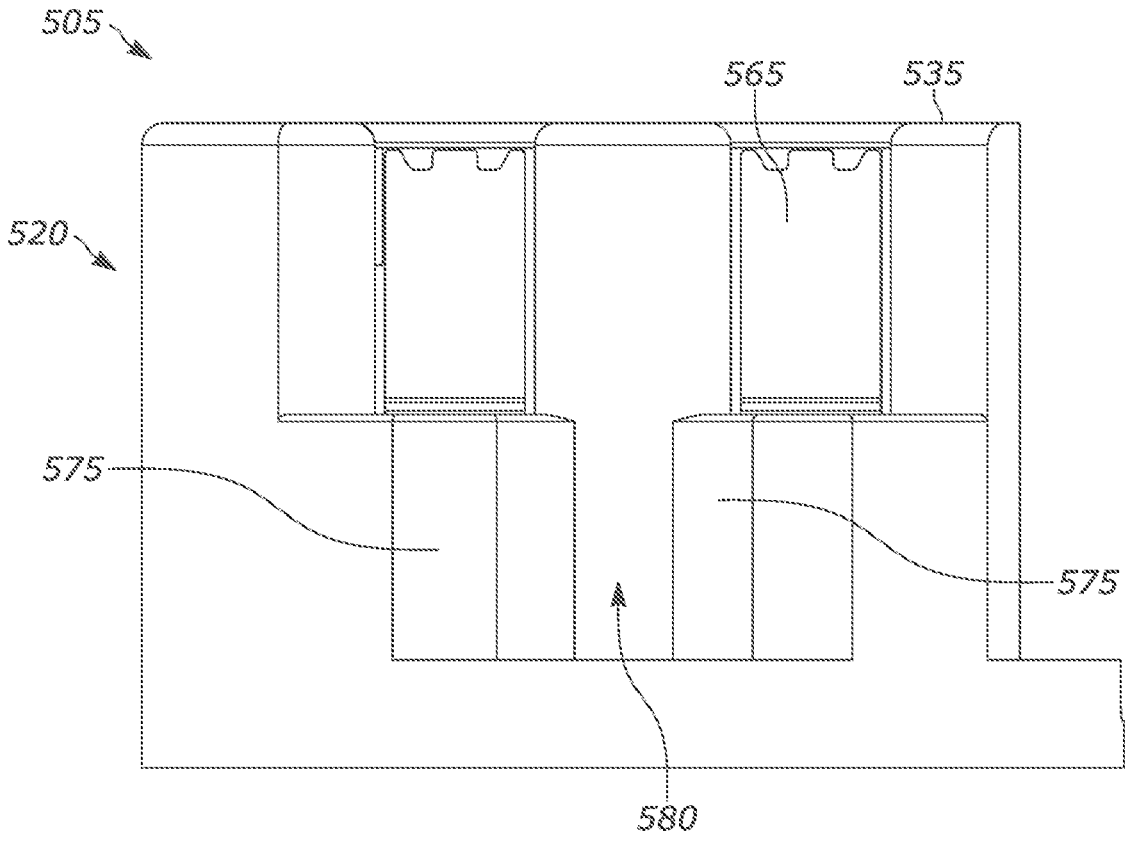
FIG. 27 is a side view of the ceiling fan box of FIG. 20.

As shown in FIG. 24, a pair of first protrusions 595 may extend from the inner surface of the riser portion 520. The first protrusions 595 may be aligned on opposite sides of the ceiling fan box 505. In some forms, the apertures 525 may extend through the protrusions 595.

FIG. 24 also illustrates a second protrusion 600. In the illustrated example, the second protrusion 600 may be disposed between the pair of first protrusions 595. In some forms, the second protrusion 200 may be disposed an equal distance between each of the first protrusions 595 (e.g., about 90° apart), although in other examples the second protrusion 600 may be closer to one of the first protrusions 595.

In some forms, the ceiling fan box 505 may be constructed at least partially from a non-metallic material. For example, the ceiling fan box 505 may be constructed entirely from plastic, although in other examples, portions of the ceiling fan box 505 may be metallic. Constructing the ceiling fan box 505 from a non-metallic material may assist in reducing the overall weight of the ceiling mounting assembly 500.

Figure 28:
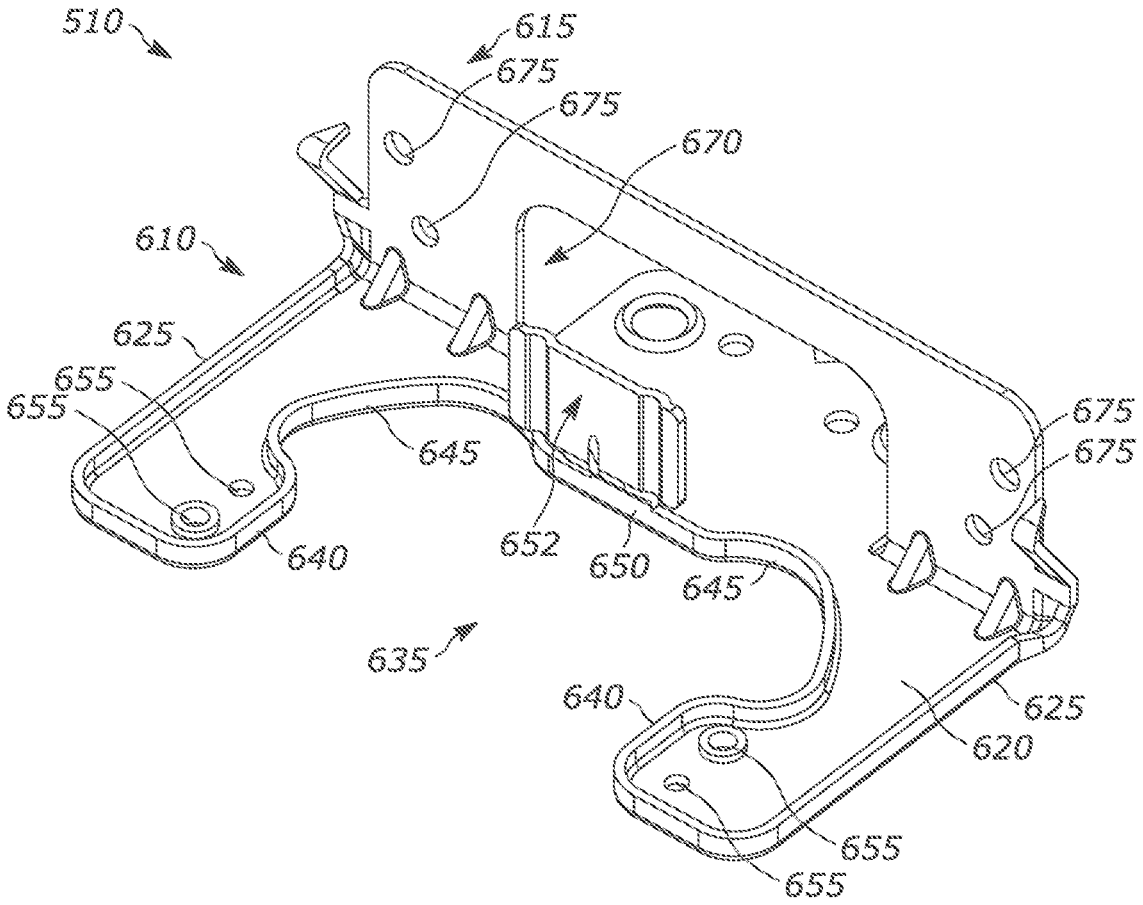
FIG. 28 is a perspective view of a bracket of the ceiling mounting assembly of FIG. 19.
Figure 29:
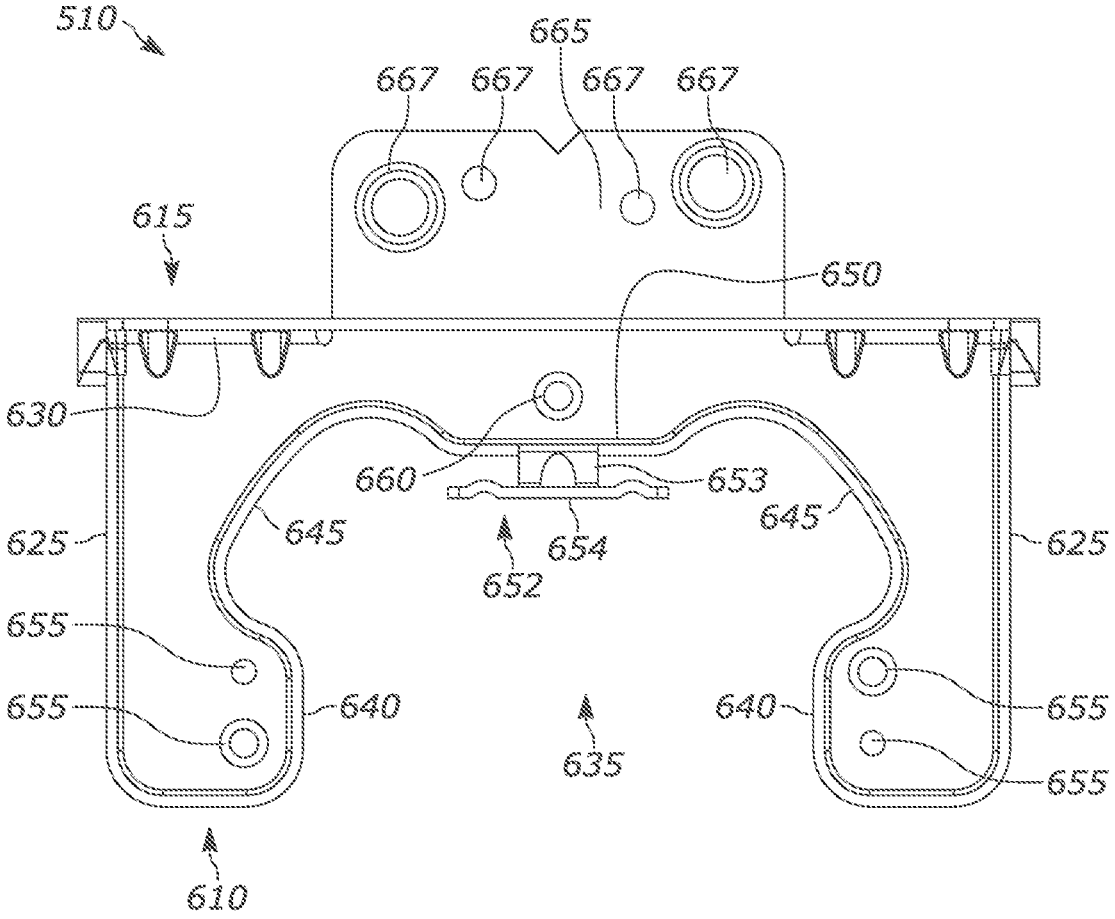
FIG. 29 is a top view of the bracket of FIG. 28.

FIGS. 28 and 29 illustrate the mounting bracket 510 that is part of the ceiling mounted assembly 500. The mounting bracket 510 includes a base portion 610 and an upper support portion 615 that extends from the base portion 610. In the illustrated example, the base portion 610 and the upper support portion 615 are oriented approximately perpendicularly with respect to one another. In other examples, the upper support portion 615 may be inclined with respect to the base portion 610 (e.g., oriented at an angle other than 90°).

In some forms, the base portion 610 may include a first section 620 with a substantially C-shape or U-shape. For example, the first section 620 may include a pair of side edges 625 and a front edge 630. As shown in FIG. 29, the side edges 625 may be substantially parallel to one another and the front edge 630 may be substantially perpendicular to the side edges 625.

The base portion 610 may include an opening 635 between the pair of side edges 625. For example, the opening 635 may extend into the base portion toward the front edge 630 so that an opening to the opening 635 is distal to the front edge 630.

The shape of the opening 635 may be substantially like the shape of at least a portion of the riser portion 520. For example, a pair of planar edges 640 may be disposed proximate to the entrance of the opening 635. A curved region 645 may be disposed adjacent to each planar edge 640. A central portion 650 may be disposed between the two curved regions 645. The central portion 650 may be disposed proximate to a center of the opening 635 so that each curved region 645 is substantially the same size and shape. This orientation may form a forked-region (e.g., because of the protruding portion 650 being spaced apart from the planar edges 640 and the side edges 625).

The opening 635 may include a different shape if a differently shaped riser portion 520 is used. For example, the radius of curvature of the curved regions 645 and/or the presence of the central portion 650 may change to better conform to the shape of a different riser portion 520.

In still other examples, the opening 635 may include a shape usable with a variety of shaped riser portions 520. For example, the opening 635 may be at least partially circular (e.g., semi-circular). The partially circular opening 635 may be sized to at least partially extend around the riser portion 520, although it may not snuggle conform to all regions of the illustrated riser portion 520.

In some forms, a pair of apertures 655 may be disposed on the first section 620 proximate to the pair of planar edges 640. Each pair of apertures 655 may be substantially the same size and shape as the pair of apertures 625 on the flange 615. The central portion 650 may also include an aperture 660.

In some forms, the base portion 610 includes a second portion 665 that is connected to the first portion 620. For example, the second portion 665 may be connected to the front edge 630 of the first portion 620. As shown in FIG. 29, the length of the second portion 665 may be less than the length of the front edge 630. The second portion 665 may also include at least one aperture 667 (e.g., four shown). The illustrated apertures 667 have different sizes, although all of the apertures 667 may be the same size.

The upper support portion 615 may be connected to the front edge 630 on either side of the second portion 665. The upper support portion 615 may include a U-shape or a C-shape with a central opening 670 that has approximately the same width as the second portion 665. The upper support portion 615 may also include at least one aperture 675. The illustrated apertures 675 (e.g., six shown) may be disposed on either side of the central opening 670.

In some forms, the first and second portions 620, 665 may be formed from a one-piece unitary construction. This connection is illustrated as being substantially planar, although other orientations (e.g., bent) may be used. Additionally, the base portion 610 and the upper support portion 615 may be formed as a one-piece unitary construction. For example, the upper support portion 615 may be bent relative to the base portion 610. In other examples, the upper support portion 615 is initially separate from the base portion 610 and is later connected to the base portion 610 (e.g., using welding).

A finger 652 is coupled to the base portion 610 proximate to the central portion 650. The finger 652 extends upwardly from the base portion 610 in a direction substantially parallel to the upper support portion 615.

In some forms, the finger 652 may be at least partially planar and may have a complementary shape to the channel 557. For example, ends of the finger 652 may include a complementary shape as the fingers 558.

Figure 30:
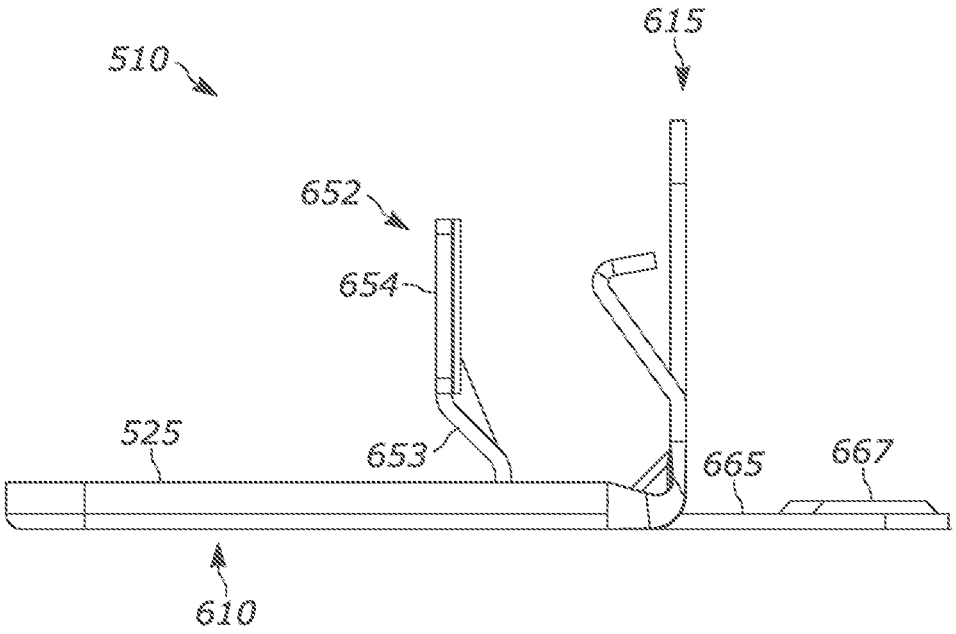
FIG. 30 is a side view of the bracket of FIG. 28.

As shown in FIGS. 29 and 30, the finger 652 may include a first or lower portion 653 and a second or upper portion 654. The lower portion 653 may be directly connected to the first portion 620. The lower portion 653 of the finger 652 may be positioned between the first portion 620 and the upper portion 654 of the finger 652. The upper portion 654 may be formed as a cantilever member with a free end distal to the first portion 620.

In some forms, the lower portion 653 of the finger 652 may be angled relative to the lower portion 620. For example, this may be an oblique angle (e.g., the lower portion is not perpendicular to the lower portion 620). The lower portion 620 may extend away from the upper support portion 615 and into a space above the opening 635. The illustrated upper portion 654 may be inclined relative to the lower portion 620, although the upper portion 654 may be disposed at any angle.

In some forms, the mounting bracket 510 may be constructed from a metallic material. The metallic material may be resistant to bending or flexing while the ceiling mounting assembly 500 is in use.

In some forms, the mounting bracket 510 may include a lip 677 that extends around at least a portion of the perimeter. For example, the lip 677 may extend around at least a portion of the side edges 625, the planar edges 640, the curved regions 645, and the central portion 650. The lip 677 may extend entirely around these regions or only partially around the regions (e.g., with or without discontinuities). The lip 677 may be formed as a resulting the manufacturing process, or may be later bent after the mounting bracket 510 is formed.

In some forms (not shown), the base portion 610 of the mounting bracket 510 may have a different shape. For example, the first portion 620 may not include a C-shape or U-shape. In other words, the planar edges 640 and/or the side edges 625 may not extend to a free end of the first portion 620 and form an opening 635 that does not include a complete perimeter. Instead, the opening 635 may be formed entirely within the first portion 620 so that the opening 635 has a complete perimeter.

An in-use position where the ceiling mounting assembly 500 may be similar to the in-use position shown in FIG. 1 where the ceiling mounted assembly 500 is positioned within the ceiling 50 to support the fan 25. The ceiling 50 may include an opening through which the ceiling mounting assembly 500 is at least partially received. For example, at least a portion of the lower end of the riser portion 520 may be inserted through the opening in the ceiling 50.

Figure 31:
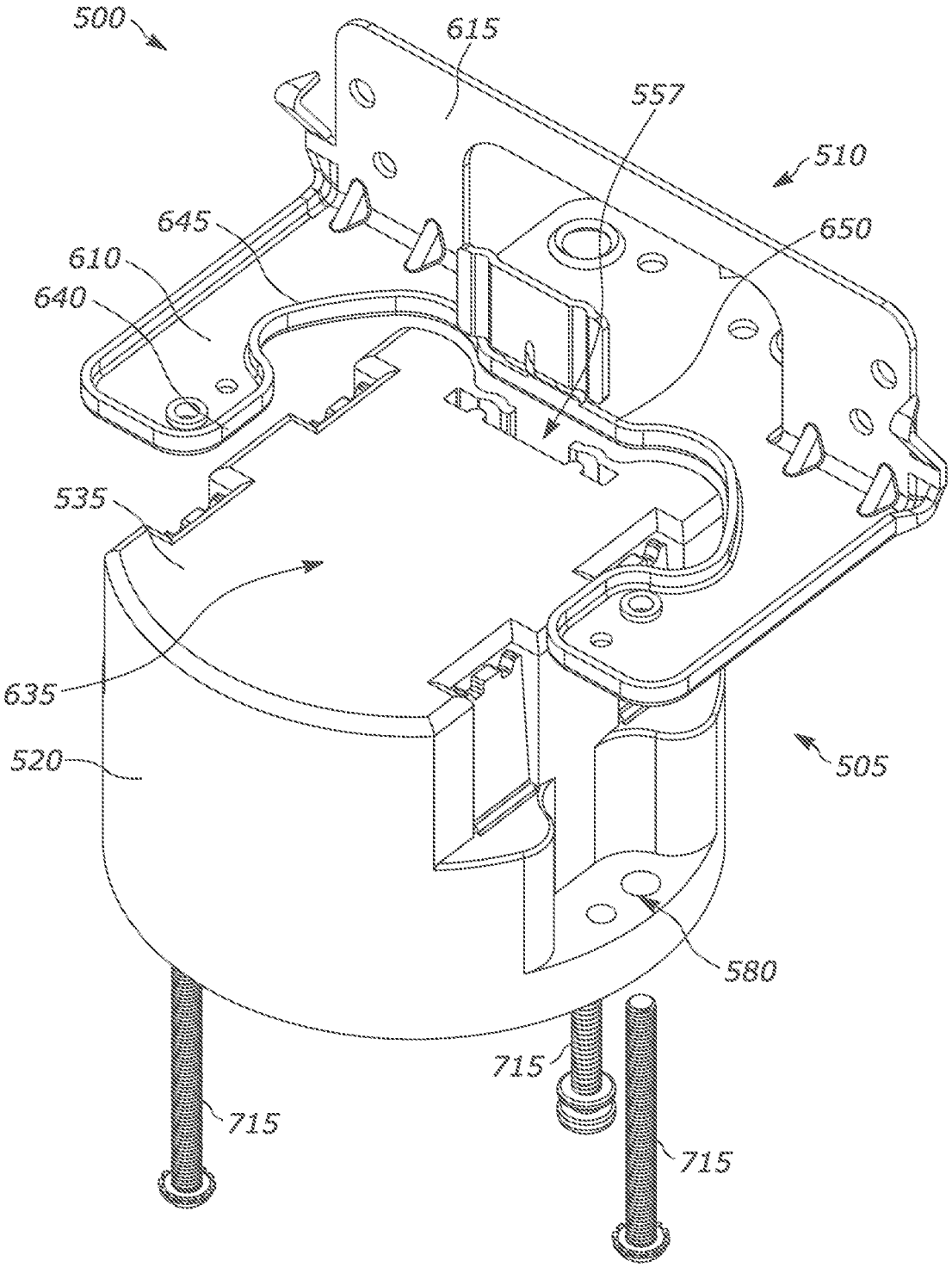
FIG. 31 is an exploded view of the ceiling mounted assembly of FIG. 19.

Prior to mounting the fan 25, the ceiling mounting assembly 500 may be assembled as illustrated in FIG. 31. Specifically, the mounting bracket 510 may be connected to the ceiling fan box 505. To do this, the mounting bracket 510 may be positioned proximate to the ceiling fan box 505 so that the central portion 650 is substantially aligned with the channel 557.

More specifically, the finger 652 may be aligned with the channel 557 to that the finger 652 can be received within the channel. The mounting bracket 510 may be initially positioned above the ceiling fan box 505 (e.g., proximate to the upper surface 535). In this position, the finger 652 may be positioned above the channel 557. The inclined orientation of the lower portion 653 positions the upper portion 654 away from the base portion 610 to minimize interference.

Figure 33:
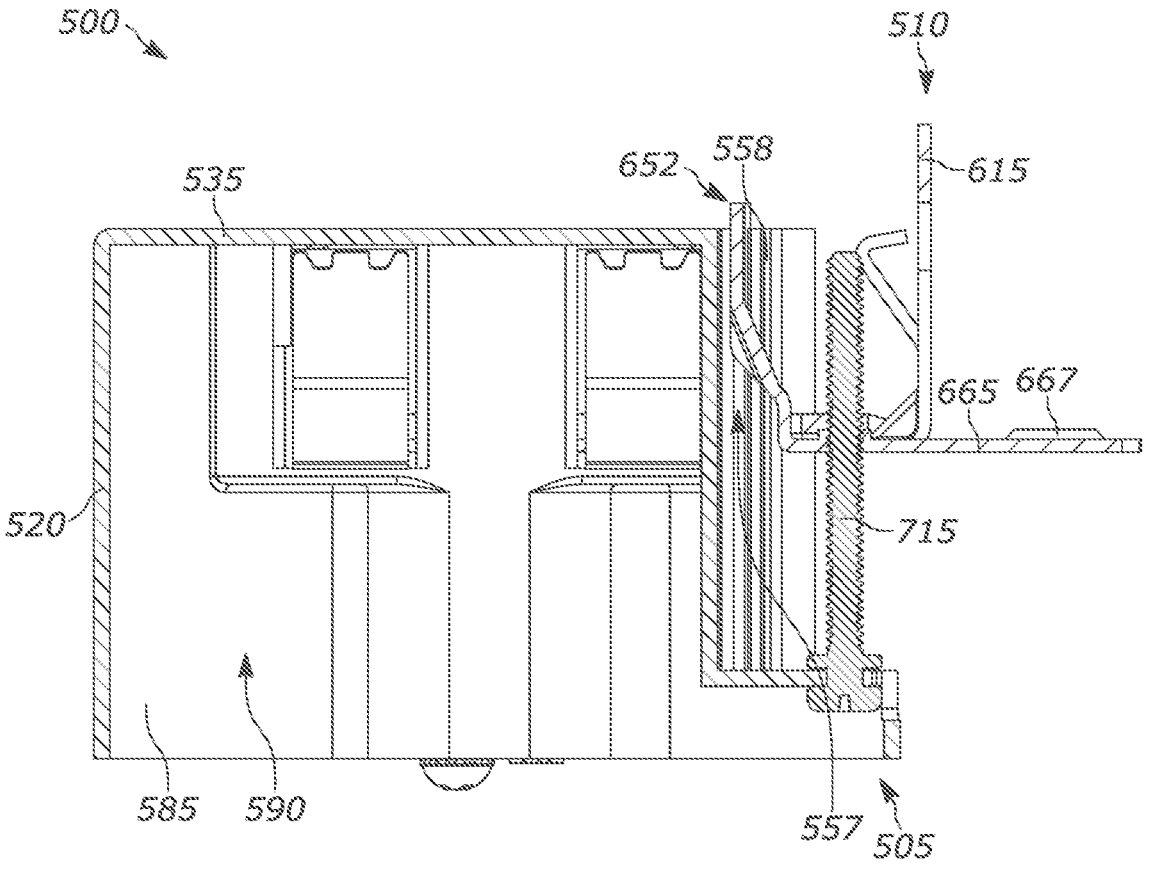
FIG. 33 is a cross-sectional view of the ceiling mounted assembly of FIG. 32.

As the mounting bracket 510 moves toward the riser portion 520, the finger 652 may be received within the channel 557. As shown in FIG. 33, the finger 652 may be received between a surface of the riser portion 520 and the fingers 558. In some forms, there may be clearance between the finger 652 and both surfaces to permit free movement within the channel 557, although in other examples there may be a snug fit.

The lower portion 653 may be received at least partially outside of the channel 557. For example, the inclination of the lower portion 653 may permit the lower portion 653 to exit the channel 557. The gap between the fingers 558 may provide a space from the lower portion 653 to exit the channel 557. In other words, a width of the lower portion 653 may be less than a space between the fingers 558.

Additionally, the curved regions 645 may have a complementary shape as the front walls 540. For example, one curved region 645 may correspond to one portion of the front wall 540 (e.g., on one side of the channel 557). Each curved region 645 may be larger than the respective portion of the front wall 540. When the central portion 650 and the channel 557 are aligned, each curved region may extend toward one of the curved portions 575 of the lower portion 570 of the side wall 550. An end of each curved region 645 may also be complementary with the respective curved portion 575 (e.g., because of a substantially similar radius of curvature). Finally, the planar edges 640 of the mounting bracket 510 may include a substantially complementary shape to the groove 580 between two of the curved portions 575.

Once the mounting bracket 510 is aligned with the ceiling fan box 505 as described above, a technician may move the mounting bracket 510 into a first connecting position where the mounting bracket 510 moves from above the upper surface 535 toward the flange 515 (see e.g., FIG. 19). In the first connecting position, the central portion 650 will be positioned within the channel 557 and each planar edge 540 will be positioned within a respective one of the grooves 580. Additionally, the mounting bracket 510 will rest on the surface of the flange 515 so that it is spaced apart from (e.g., not in contact with) the upper surface 535.

In other examples, the technician may first align the mounting bracket 510 in front of the ceiling fan box 505. For example, the central portion 650 may be aligned with the channel 557 and the planar edges 640 are positioned proximate to the front wall 540. The technician may then move the mounting bracket 510 toward the ceiling fan box 505 so that the planar edges 640 move past the front wall 540 and into the grooves 580 (e.g., with a snap-fit). As this occurs, the central portion 650 may be received within the channel 557. This may be used with the distance between the planar edges 640 are larger than the width of the riser portion 520 and/or when the first portion 620 is at least partially constructed from a resilient material.

In still other examples where the ceiling fan box 505 lacks a flange 515 (e.g., where there is no surface within the groove 580 that extends to an outer perimeter of the riser portion 520), the technician may first align the mounting bracket 510 below the ceiling fan box (e.g., proximate to the cavity 590) and move the mounting bracket 510 up into the connected position.

The mounting bracket 510 may be snuggly connected to the ceiling fan box 505 in this position (e.g., even without the use of fasteners). For example, the complementary shape of the opening 635 and the outer perimeter of the riser portion 520 may limit relative rotational movement between the mounting bracket 510 and the ceiling fan box 505. Positioning the central portion 650 within the channel 557 and the planar edges 640 within the respective groove 580 limits relative rotation of the mounting flange 510 and helps to maintain its position.

In this position illustrated in FIG. 19, openings on the mounting bracket 510 may be aligned with openings on the ceiling fan box 505. For example, the apertures 525 on the flange 515 may be aligned with the apertures 655 of the mounting bracket 510 when each planar edge 640 is disposed within the respective groove 580.

When these elements are aligned, one or more fasteners may be used to connect the ceiling mounting assembly 500 together. A fastener (e.g., a threaded screw) 715 may be inserted through the aperture 660 of the central portion 650. For example, the fastener 715 may be used to connect all the ceiling fan box 505 and the mounting bracket 510 together.

Figure 32:
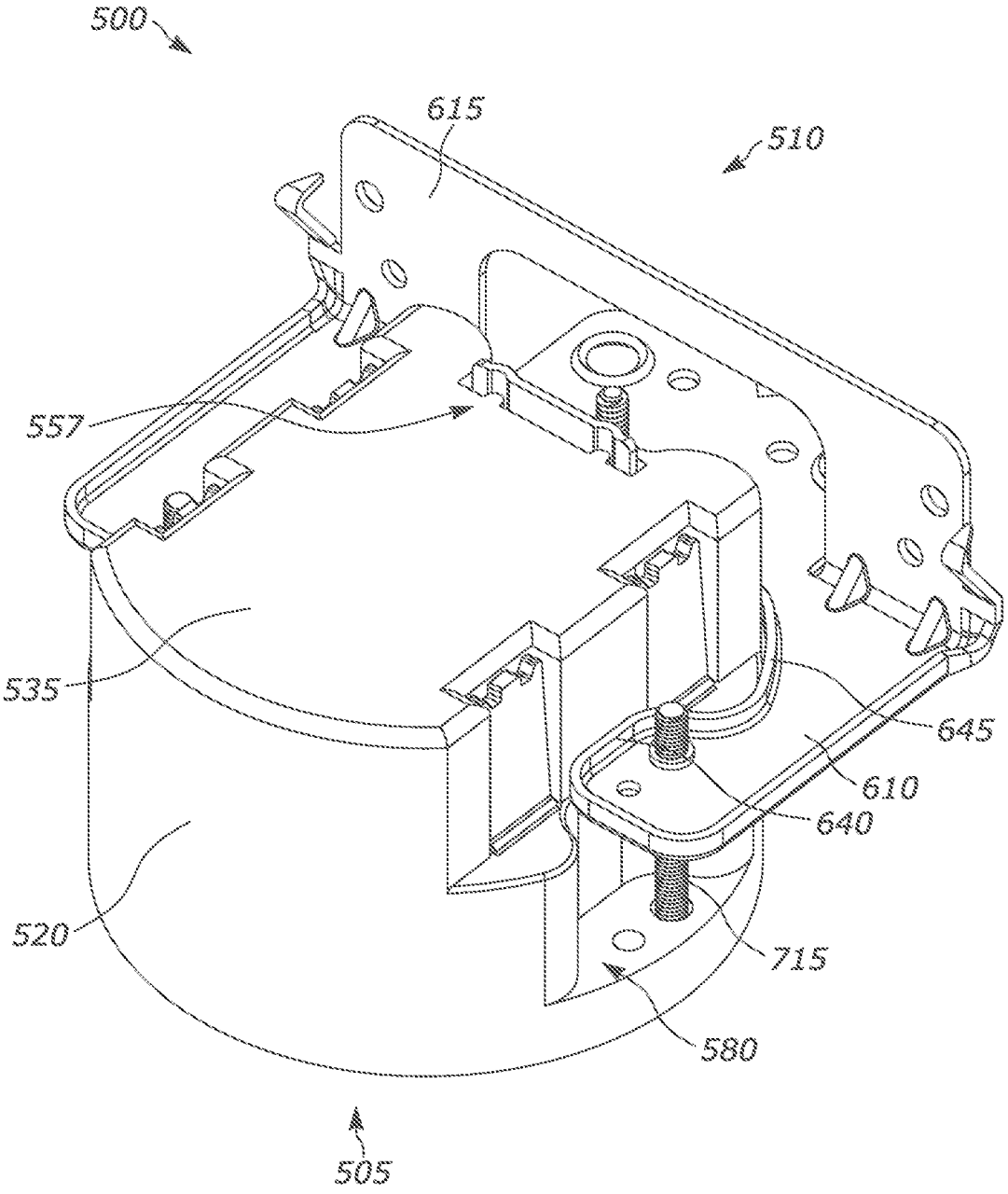
FIG. 32 is a perspective view of the ceiling mounted assembly of FIG. 19 with the ceiling fan box in a second position.

Fasteners 715 may be inserted through the aligned apertures 525, 655. The illustrated example of FIGS. 31 and 32 shows only one fastener 715 proximate to either planar edge 640 (e.g., so that one of both aperture 525 and aperture 655 in each pair of apertures does not receive a fastener 715). However, other examples may include fasteners through all the apertures 525, 655.

The fasteners 715 may be longer than the fasteners used with the ceiling mounting bracket 100. For example, the fasteners 715 may extend substantially along a height (e.g., more than half) of the riser portion 520 when connected to the ceiling fan box 505.

As shown in FIGS. 32 and 33, the elongated fasteners 715 may permit the mounting bracket 510 to move relative to the riser portion 520. For example, the mounting bracket 510 may be translatable relative to the riser portion 520. When the width of the finger 652 is spaced apart from the surfaces forming the channel 557, the mounting bracket 510 may not be able to maintain its position away from the flange 515 without an additional structure. In the illustrated example, the mounting bracket 510 may be able to move along the length of the elongated fasteners 715, which may be threadedly connected to the mounting bracket 510. The elongated fasteners 715 may therefore support the mounting bracket 510 at a selectable height above the flange 515.

Figure 34:
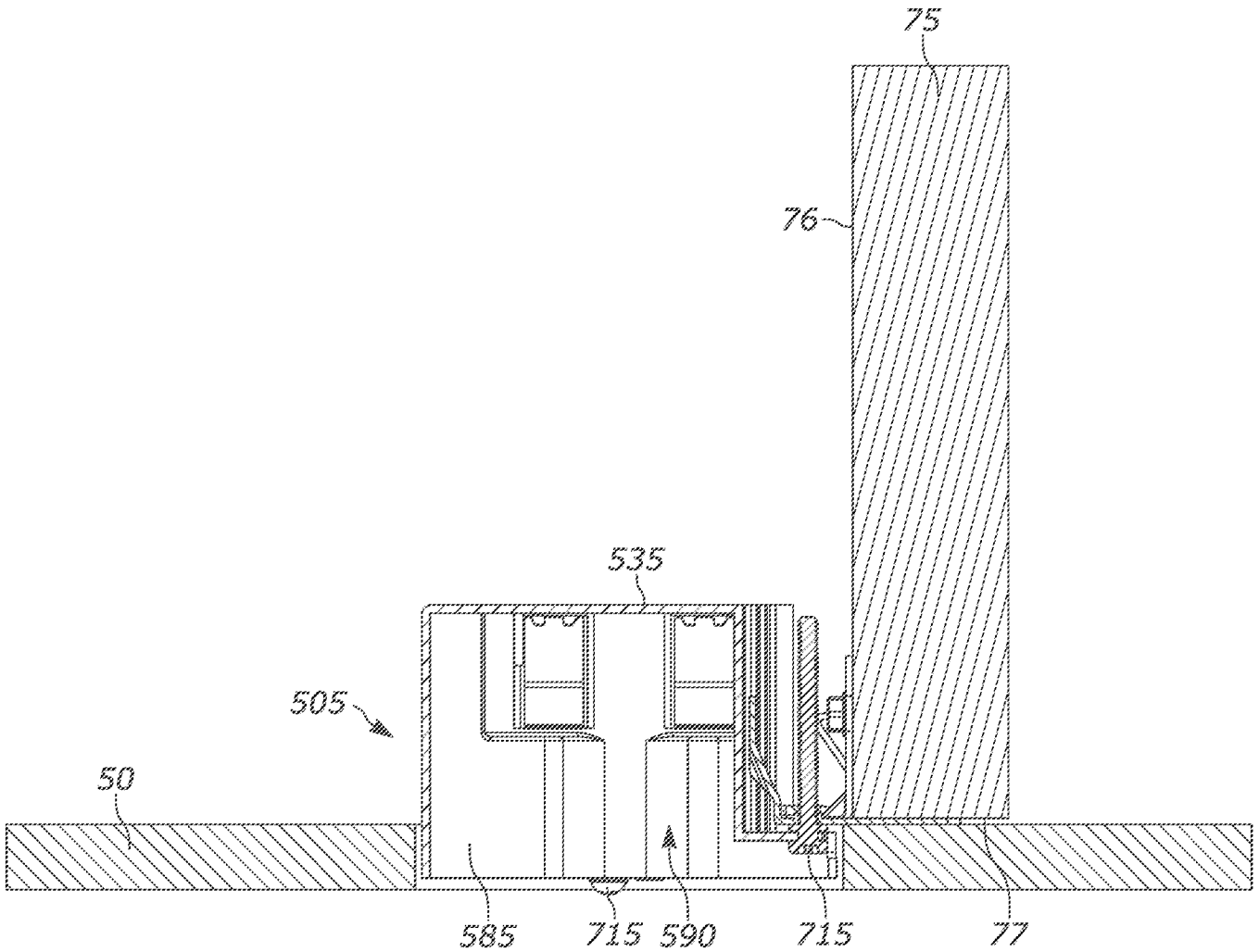
FIG. 34 is a first cross-sectional view of the ceiling mounted assembly of FIG. 19 mounted in a ceiling.

As illustrated in FIG. 34, the ceiling mounted assembly 500 may be positioned within an opening of the ceiling 50 proximate to a support 75 (e.g., an engineering joist). As described in more detail below, the ceiling mounted assembly 500 may be connected to the support 75 in an in-use position.

When positioned within the ceiling 50, the ceiling mounting assembly 100 may be oriented so that the mounting bracket 510 is proximate to the support 75. For example, at least a portion of the mounting bracket 510 may be in contact with the support 75.

With continued reference to FIG. 34, the upper support portion 615 of the mounting bracket 510 may be positioned adjacent to a surface of the support 75. For example, the upper support portion 615 may contact a surface of the support that is substantially perpendicular to the surface of the ceiling 50 that the hole in the ceiling passes through.

Figure 35:
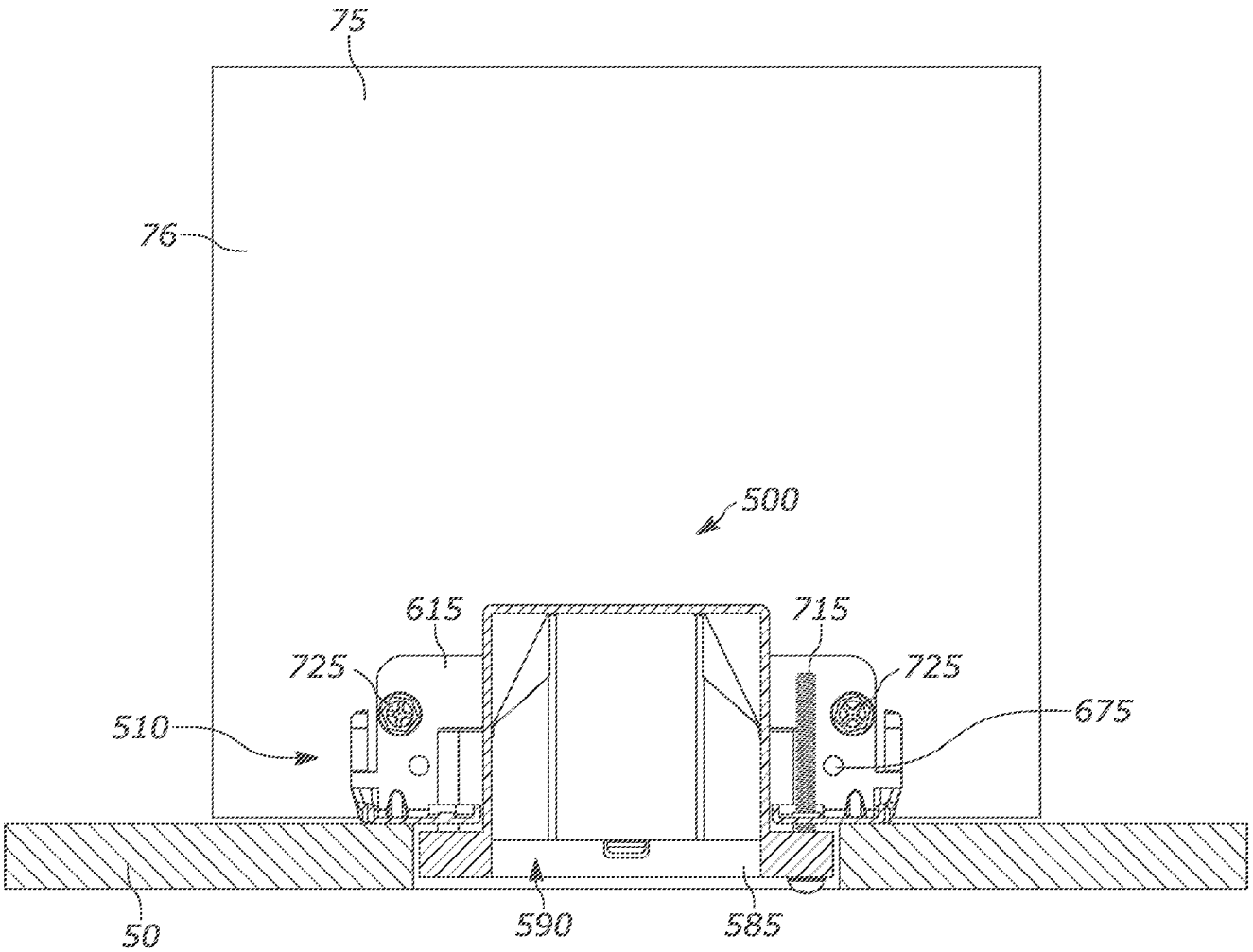
FIG. 35 is a second cross-sectional view of the ceiling mounted assembly of FIG. 19 mounted in a ceiling.

In this position, the apertures 675 of the upper support portion 615 may also be adjacent to the surface of the support 75. As illustrated in FIG. 35, fasteners 725 (e.g., threaded fasteners) may be inserted through one or more of the apertures 675 (e.g., two shown) and into the support 75, which may secure the ceiling mounted assembly 500 relative to the support 75 within the ceiling 50.

The ceiling mounting assembly 500 may also be positioned so that at least a portion of the mounting bracket 510 is disposed between a portion of the ceiling 50 and the support 75. For example, at least a portion of the mounting bracket 510 may be sandwiched between the ceiling 50 and the support 75.

Figure 36:
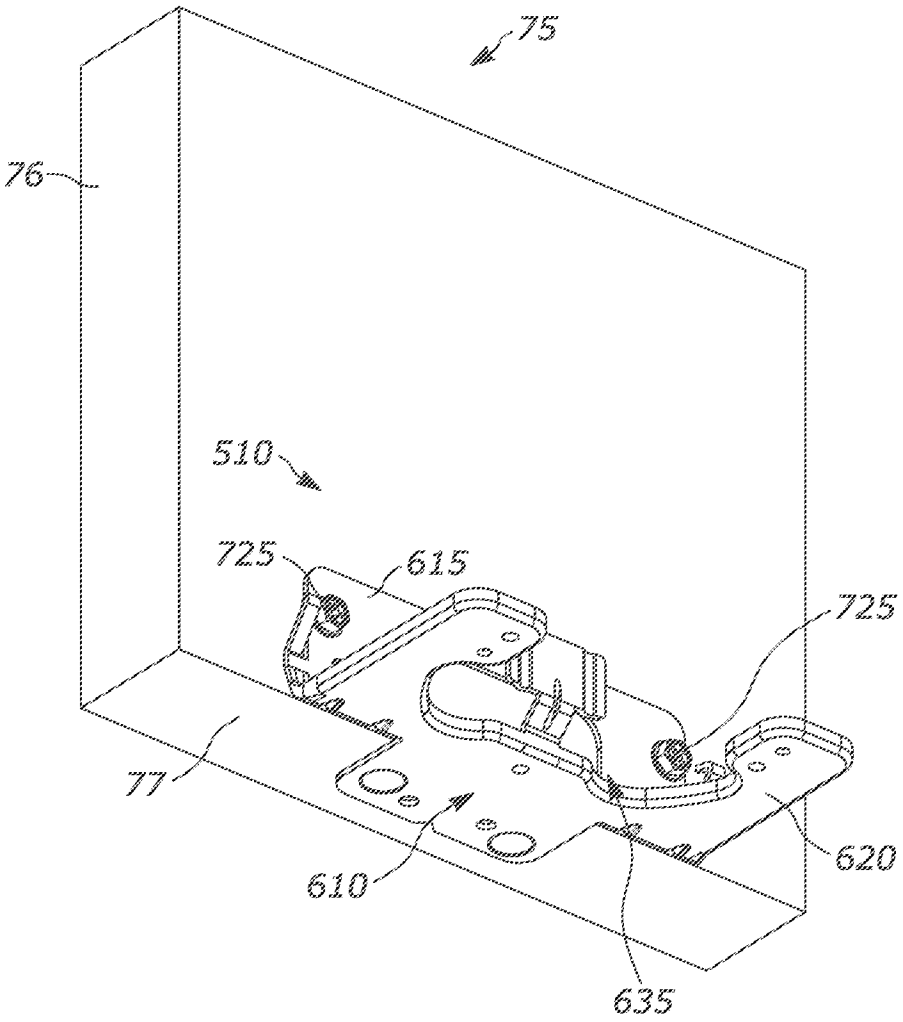
FIG. 36 is a bottom perspective view of the bracket of FIG. 28 connected to a joist.

As shown in FIG. 36, the orientation of the upper support portion 615 and the second portion (e.g., a substantially perpendicular orientation) may allow the mounting bracket 510 to connect to two perpendicular surfaces of the support 75 (e.g., a first surface 76 and a second surface 77 at the same time). For example, the upper support portion 615 may contact a first surface 76 of the support 75 that is oriented substantially perpendicular with respect to the ceiling 50. The second portion 665 may contact a second surface 77 of the support 75 that is substantially parallel to the ceiling 50 (and therefore substantially perpendicular to the first surface 76).

A least one fastener (e.g., threaded fasteners not shown but similar to fasteners 330) may be inserted through at least one of the apertures 667 in the second portion 665 to connect the second portion 665 to the support 75. The fastener may be inserted through the respective aperture 667 directly into the surface of the support 75 as a result of the close positioning (e.g., contact) of the second portion 665 relative to the support 75.

Returning to FIG. 34, the second portion 665 of the base portion 610 of the mounting bracket 510 may be at least partially disposed between the ceiling 50 and the support 75. The substantially planar second portion 665 may be parallel with respect to the second surface 77. The incline of the upper support portion 615 relative to the second portion 665 may allow the mounting bracket 510 to sit substantially flush against both surfaces of the support 75.

Because the ceiling fan box 505 does not include a flange that extends beyond an outermost perimeter of the riser portion 520, a portion of the ceiling fan box 505 may not be fixed between the ceiling 50 and the support 75. The ceiling fan box 505 may therefore be able to move relative to the mounting bracket 505 fixed to the support 75. As described above, the fasteners 715 may be loosened or tightened to permit the relative movement between the ceiling fan box 505 and the mounting bracket 510 (e.g., tightening the fasteners 715 moves the mounting bracket 510 closer to the flange 515).

The length of the fasteners 715 may be sufficiently long to permit the ceiling fan box 505 and the mounting bracket 510 to remain connected as the finger 654 moves through the channel 557.

This adjustment may permit a technician to adjust the position of the ceiling fan box 505 based on a thickness of the ceiling 50. For example, thicker ceilings 50 may require a greater spacing between the mounting bracket 510 and the flange 515 (e.g., loosening the fasteners 715) so that an opening to the cavity 590 is proximate to the exposed surface of the ceiling 50. Adjusting the position of the ceiling fan box 505 may therefore permit a single size of a ceiling fan box 505 to be used with a variety of ceiling thicknesses.

Installing the ceiling mounting assembly 500 in this position may increase the weight that the ceiling mounting assembly 500 can support. For example, connecting the mounting bracket 510 directly to the support 75 (e.g., at the first surface) and/or positioning at least a portion of the mounting bracket 510 beneath the support 75 (e.g., at the second surface 77) provides for a stronger connection (e.g., as compared to a brace that spans two supports 75) because the mounting bracket is connected to two (parallel) surfaces of the support 75. This connection may decrease a moment arm and allow for the connection to a heavier fan 25. Additionally, using fasteners 725 to connect the mounting bracket 510 to the support 75 may provide a stronger connection as compared to connecting the ceiling fan box 505 in a center of a brace.

One of ordinary skill will appreciate that the exact dimensions and materials are not critical to the disclosure and all suitable variations should be deemed to be within the scope of the disclosure if deemed suitable for carrying out the objects of the disclosure.

One of ordinary skill in the art will also readily appreciate that it is well within the ability of the ordinarily skilled artisan to modify one or more of the constituent parts for carrying out the various examples of the disclosure. Once armed with the present specification, routine experimentation is all that is needed to determine adjustments and modifications that will carry out the present disclosure.

The above examples are for illustrative purposes and are not intended to limit the scope of the disclosure or the adaptation of the features described herein. Those skilled in the art will also appreciate that various adaptations and modifications of the above-described preferred examples can be configured without departing from the scope and spirit of the disclosure. Therefore, it is to be understood that, within the scope of the appended claims, the disclosure may be practiced other than as specifically described.

What is claimed is:

1. A mounting bracket for supporting a ceiling fan and ceiling fan box, the mounting bracket comprising:

a base portion comprising, a first portion having a pair of side edges and a front edge extending at least partially between the pair of side edges, an opening formed between the pair of side edges and the front edge and extending through the base portion toward the front edge wherein the opening includes, a protruding portion at an end of the opening proximate to the front edge;

a curved portion on either side of the protruding portion; and a planar edge adjacent to each curved portion, and a second portion integrally formed with the first portion and connected to the front edge, the second portion extending away from the opening; and an upper support portion integrally formed with the base portion and connected to the front edge between the first portion and the second portion;

wherein the opening is configured to at least partially surround a perimeter of the ceiling fan box;

wherein the upper support portion is configured to engage a first surface of a joist in a ceiling; and wherein the second portion is configured to engage a second surface of the joist in the ceiling.

2. The mounting bracket of claim 1, wherein the first portion includes at least one aperture proximate to the protruding portion and/or the planar edges, the at least one aperture configured to receive a fastener for connecting the base portion to the ceiling fan box.

3. The mounting bracket of claim 1, wherein the upper support portion is substantially perpendicular with respect to the base portion.

4. The mounting bracket of claim 1, wherein the upper support portion includes at least one aperture configured to receive a fastener that passes directly into the first surface of the joist in the in-use position.

5. The mounting bracket of claim 1, wherein the second portion includes at least one aperture configured to receive a fastener that passes directly into the second surface of the joist in the in-use position.

6. The mounting bracket of claim 1, wherein a finger extends from the first portion and is configured to be received within a channel of the ceiling fan box, wherein the finger includes a lower portion connected to the first portion and an upper portion formed as a cantilever portion that extends from the lower portion.

7. The mounting bracket of claim 6, wherein the lower portion is inclined relative to the first portion at an oblique angle and wherein the upper portion is inclined relative to the lower portion at an oblique angle, and wherein the upper portion is parallel to the upper support portion.

8. The mounting bracket of claim 1, wherein a length of the second portion is less than a length of the first portion.

9. A mounting bracket for supporting a ceiling fan and ceiling fan box, the mounting bracket comprising:

a base portion comprising, a first portion having a pair of side edges and a front edge extending at least partially between the pair of side edges, an opening formed between the pair of side edges and the front edge and extending through the base portion toward the front edge, and a second portion integrally formed with the first portion and connected to the front edge, the second portion extending away from the opening; and an upper support portion integrally formed with the base portion and connected to the front edge between the first portion and the second portion;

wherein the opening is configured to at least partially surround a perimeter of the ceiling fan box;

wherein the upper support portion is configured to engage a first surface of a joist in a ceiling; and wherein the second portion is configured to engage a second surface of the joist in the ceiling;

wherein a finger extends from the first portion and is configured to be received within a channel of the ceiling fan box, wherein the finger includes a lower portion connected to the first portion and an upper portion formed as a cantilever portion that extends from the lower portion; and wherein the lower portion is inclined relative to the first portion at an oblique angle and wherein the upper portion is inclined relative to the lower portion at an oblique angle, and wherein the upper portion is parallel to the upper support portion.

10. The mounting bracket of claim 9, wherein the opening further comprises:

a protruding portion at an end of the opening proximate to the front edge; and a curved portion on either side of the protruding portion.

11. The mounting bracket of claim 10, wherein the first portion includes at least one aperture proximate to the planar edges, the at least one aperture configured to receive a fastener for connecting the base portion to the ceiling fan box.

12. The mounting bracket of claim 9, wherein the upper support portion is substantially perpendicular with respect to the base portion.

13. The mounting bracket of claim 9, wherein the upper support portion includes at least one aperture configured to receive a fastener that passes directly into the first surface of the joist in the in-use position.

14. The mounting bracket of claim 9, wherein the second portion includes at least one aperture configured to receive a fastener that passes directly into the second surface of the joist in the in-use position.

15. The mounting bracket of claim 9, wherein a length of the second portion is less than a length of the first portion.

16. A mounting bracket for supporting a ceiling fan and ceiling fan box, the mounting bracket comprising:

a base portion comprising, a first portion having a pair of side edges and a front edge extending at least partially between the pair of side edges, an opening formed between the pair of side edges and the front edge and extending through the base portion toward the front edge wherein the opening includes, a protruding portion at an end of the opening proximate to the front edge;

a curved portion on either side of the protruding portion; and a planar edge adjacent to each curved portion, and a second portion extending away from the opening; and an upper support portion connected to the front edge between the first portion and the second portion;

wherein the opening is configured to at least partially surround a perimeter of the ceiling fan box;

wherein the upper support portion is configured to engage a first surface of a joist in a ceiling; and wherein the second portion is configured to engage a second surface of the joist in the ceiling.

17. The mounting bracket of claim 16, wherein the upper support portion includes at least one aperture configured to receive a fastener that passes directly into the first surface of the joist in the in-use position.

18. The mounting bracket of claim 16, wherein the second portion includes at least one aperture configured to receive a fastener that passes directly into the second surface of the joist in the in-use position.

19. The mounting bracket of claim 16, wherein, a finger extends from the first portion and is configured to be received within a channel of the ceiling fan box, wherein the finger includes a lower portion connected to the first portion and an upper portion formed as a cantilever portion that extends from the lower portion; and the lower portion is inclined relative to the first portion at an oblique angle and wherein the upper portion is inclined relative to the lower portion at an oblique angle, and wherein the upper portion is parallel to the upper support portion.

20. The mounting bracket of claim 16, wherein the first portion includes at least one aperture proximate to the planar edges, the at least one aperture configured to receive a fastener for connecting the base portion to the ceiling fan box.

* * * * *